US006270336B1

(12) United States Patent
Terashima et al.

(10) Patent No.: US 6,270,336 B1
(45) Date of Patent: Aug. 7, 2001

(54) CATALYTIC COMBUSTION SYSTEM AND COMBUSTION CONTROL METHOD

(75) Inventors: Tetsuo Terashima, Hirakata; Kiyoshi Taguchi, Moriguchi; Yoshitaka Kawasaki, Nabari; Motohiro Suzuki, Moriguchi; Jiro Suzuki, Nara, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/325,900

(22) Filed: Jun. 4, 1999

(30) Foreign Application Priority Data

Jun. 5, 1998 (JP) ..... 10-157555

(51) Int. Cl.[7] ..... F23D 11/44; F23C 6/04

(52) U.S. Cl. ..... 431/6; 431/7; 431/11; 431/268; 431/328; 431/161; 60/723

(58) Field of Search ..... 431/6, 7, 11, 170, 431/268, 326, 328, 329, 161; 60/723

(56) References Cited

U.S. PATENT DOCUMENTS

| | | | | |
|---|---|---|---|---|
| 4,230,443 | * | 10/1980 | Berg et al. | 431/328 |
| 4,321,233 | * | 3/1982 | Tsuhi et al. | 431/170 |
| 4,354,821 | * | 10/1982 | Kesselring et al. | 431/7 |
| 4,459,126 | | 7/1984 | Krill et al. . | |
| 5,019,546 | | 5/1991 | Murakami et al. . | |
| 5,022,226 | * | 6/1991 | Bell | 60/274 |
| 5,190,453 | | 3/1993 | Le et al. . | |
| 5,207,053 | | 5/1993 | Spadaccini et al. . | |
| 5,235,804 | | 8/1993 | Colket, III et al. . | |
| 5,258,349 | | 11/1993 | Dalla Betta et al. . | |
| 5,588,298 | * | 12/1996 | Kalina et al. | 60/676 |

FOREIGN PATENT DOCUMENTS

| | | | |
|---|---|---|---|
| 44 38 356 | | 5/1996 | (DE) . |
| 0 807 786 | | 11/1997 | (EP) . |
| 61-272509 | | 12/1986 | (JP) . |
| 03056138 | | 3/1991 | (JP) . |
| 4-084009 | * | 3/1992 | (JP) . |
| 4-80505 | * | 3/1992 | (JP) . |
| 04174201 | | 6/1992 | (JP) . |
| 4-198618 | * | 7/1992 | (JP) . |
| 5-157211 | * | 6/1993 | (JP) . |
| 05157211 | | 6/1993 | (JP) . |

* cited by examiner

*Primary Examiner*—Ira S. Lazarus
*Assistant Examiner*—Josiah C. Cocks
(74) *Attorney, Agent, or Firm*—Ratner & Prestia

(57) ABSTRACT

A combustion control method for use in a catalytic combustion system having (a) a gaseous mixture inlet port, located at the upstream side of said catalytic combustion system, for the entrance of a fuel-air mixture;

(b) an exhaust gas outlet port, located at the downstream side of said catalytic combustion system, for the exit of an exhaust gas;

(c) a primary combustion chamber in which a catalyst body is disposed, said catalyst body being formed of a porous base material with numerous communicating holes that supports thereon an oxidation catalyst;

(d) a secondary supply port, located downstream of said primary combustion chamber, for the supply of a gaseous mixture or air; and (e) a secondary combustion chamber located downstream of said secondary supply port;

comprising such process that an excess air ratio of said primary combustion chamber is initially set above 1 and after the rate of combustion of said secondary combustion chamber exceeds a given level, combustion is made to take place, with the excess air ratio of said primary combustion chamber set below 1.

25 Claims, 14 Drawing Sheets

CATALYTIC COMBUSTION SYSTEM AND COMBUSTION CONTROL METHOD

BACKGROUND OF THE INVENTION

1. Field of the Invention

The present invention concerns technical means especially capable of improvement in high-temperature durability and expansion of the turn down ratio (TDR) in catalytic combustion systems which are used mainly in heat sources and heating applications for catalytic combustion of gaseous fuels or liquid fuels.

2. Related Art of the Invention

Various types of catalytic combustion systems, which use a catalyst body exhibiting an oxidation activity against the fuel to cause catalytic reactions to take place at a surface of the catalytic body, have been known in the art, and their typical combustion method is a premix type structure as shown in FIG. 1.

Referring first to FIG. 1, there is shown a commonly-used premix type structure, in which a fuel gas supplied from a fuel supply valve 1 is mixed with air supplied from an air supply valve 2 in a premix chamber 3, and is delivered to a preheat burner 5 through a premix gas inlet port 4. This premix gas is ignited by an ignition unit 6, thereby forming a flame at the preheat burner 5. High-temperature exhaust gases as a result of such flame formation pass through a catalyst body 8 disposed in a combustion chamber 7 while heating the catalyst body 8, and are discharged from an exhaust port 9. When the catalyst body 8 is heated up to reach its catalyst activity temperature, fuel supply is temporarily stopped by the fuel supply valve 1 to put out the flame formed at the preheat burner 5. Thereafter, by an immediate resupply of fuel, catalytic combustion is started again. The catalyst body 8 enters a high-temperature state. Through a glass 10 located upstream of and in a face-to-face arrangement with the catalyst body 8, the catalyst body 8 radiates heat while releasing heat in the form of exhaust gas for application of heat, heating, and drying. In the foregoing premix type structure, premix gases, whose excess air ratio (i.e., the ratio of an actual amount of air to the air amount theoretically required for fuel complete oxidation) is not less than 1, are constantly supplied to the catalyst body 8, in other words, the catalyst body 8 is operated in an atmosphere excessively abounding with oxygen.

In the above-described conventional catalytic combustion system, a high-temperature atmosphere is produced which is accompanied by the constant coexistence of oxygen at a reaction center position of the catalyst body. As a consequence, constituents of a catalyst are inevitably subject to deterioration by heat. Generally, metals of the platinum group, such as Pt, Pd, and Rh, are frequently used as catalysts for combustion in view of their heat resistance and reaction activity. However, the problem of using such metals is that at high temperatures (from 800 to 900 degrees centigrade), it is difficult to attain steady combustion performance for a long time because of reduction of the active spot count due to aggregation and transpiration of precious metal particles. In premix-type catalytic combustion systems, owing to the drop in activity, the reaction center position is shifted toward the downstream side of the catalyst body, therefore resulting in failing to maintain complete combustion. In addition to such a drawback, in the system making utilization of radiation heat from a catalyst upstream-side surface, the quantity of radiation heat decreases as the service time increases.

SUMMARY OF THE INVENTION

Bearing in mind the above-described problems with the conventional catalytic combustion system such as high-temperature durability and TDR limitation ones, the present invention was made with a view to providing catalytic combustion systems capable of improvement in high-temperature durability and expansion of the turn down ratio (TDR).

A catalytic combustion system of the present invention comprises:

(a) a gaseous mixture inlet port, located at the upstream side of said catalytic combustion system, for the entrance of a fuel-air mixture;

(b) an exhaust gas outlet port, located at the downstream side of said catalytic combustion system, for the exit of an exhaust gas;

(c) a primary combustion chamber in which a first catalyst body is disposed, said catalyst body having a porous base material with numerous communicating holes that supports thereon an oxidation catalyst;

(d) a secondary supply port, located downstream of said primary combustion chamber, for the supply of a gaseous mixture or air; and (e) a secondary combustion chamber located downstream of said secondary supply port;

wherein at the time of combustion, if a given condition is satisfied, it is arranged such that said combustion takes place, with an excess air ratio in said primary combustion chamber set below 1.

A combustion control method of the present invention for use in a catalytic combustion system having (a) a gaseous mixture inlet port, located at the upstream side of said catalytic combustion system, for the entrance of a fuel-air mixture;

(b) an exhaust gas outlet port, located at the downstream side of said catalytic combustion system, for the exit of an exhaust gas;

(c) a primary combustion chamber in which a catalyst body is disposed, said catalyst body being formed of a porous base material with numerous communicating holes that supports thereon an oxidation catalyst;

(d) a secondary supply port, located downstream of said primary combustion chamber, for the supply of a gaseous mixture or air; and (e) a secondary combustion chamber located downstream of said secondary supply port; comprises such process that the excess air ratio of said primary combustion chamber is initially set above 1 and after the rate of combustion of said secondary combustion chamber exceeds a given level, combustion is made to take place, with the excess air ratio of said primary combustion chamber set below 1.

Reference Numerals in Drawings

1 FUEL SUPPLY VALVE
2 AIR SUPPLY VALVE
3 PREMIX CHAMBER
4 GASEOUS MIXTURE INLET PORT
5 PREHEAT BURNER
6 IGNITION UNIT
7 COMBUSTION CHAMBER
8 CATALYST BODY
9 EXHAUST PORT
10 GLASS
11 PRIMARY COMBUSTION CHAMBER
12 FIRST CATALYST BODY
13 SECONDARY GASEOUS MIXTURE/AIR SUPPLY PORT
14 SECONDARY COMBUSTION CHAMBER
15 BURNER PORT
16 SECOND CATALYST BODY
17 ELECTRIC HEATER
18 TEMPERATURE SENSOR
19 HEAT EXCHANGE PART
20 TEMPERATURE SENSOR

PREFERRED EMBODIMENTS OF THE INVENTION

Embodiments of the present invention will be described by reference to the FIG.s of the drawings attached hereto.

Embodiment 1

Figure 2:
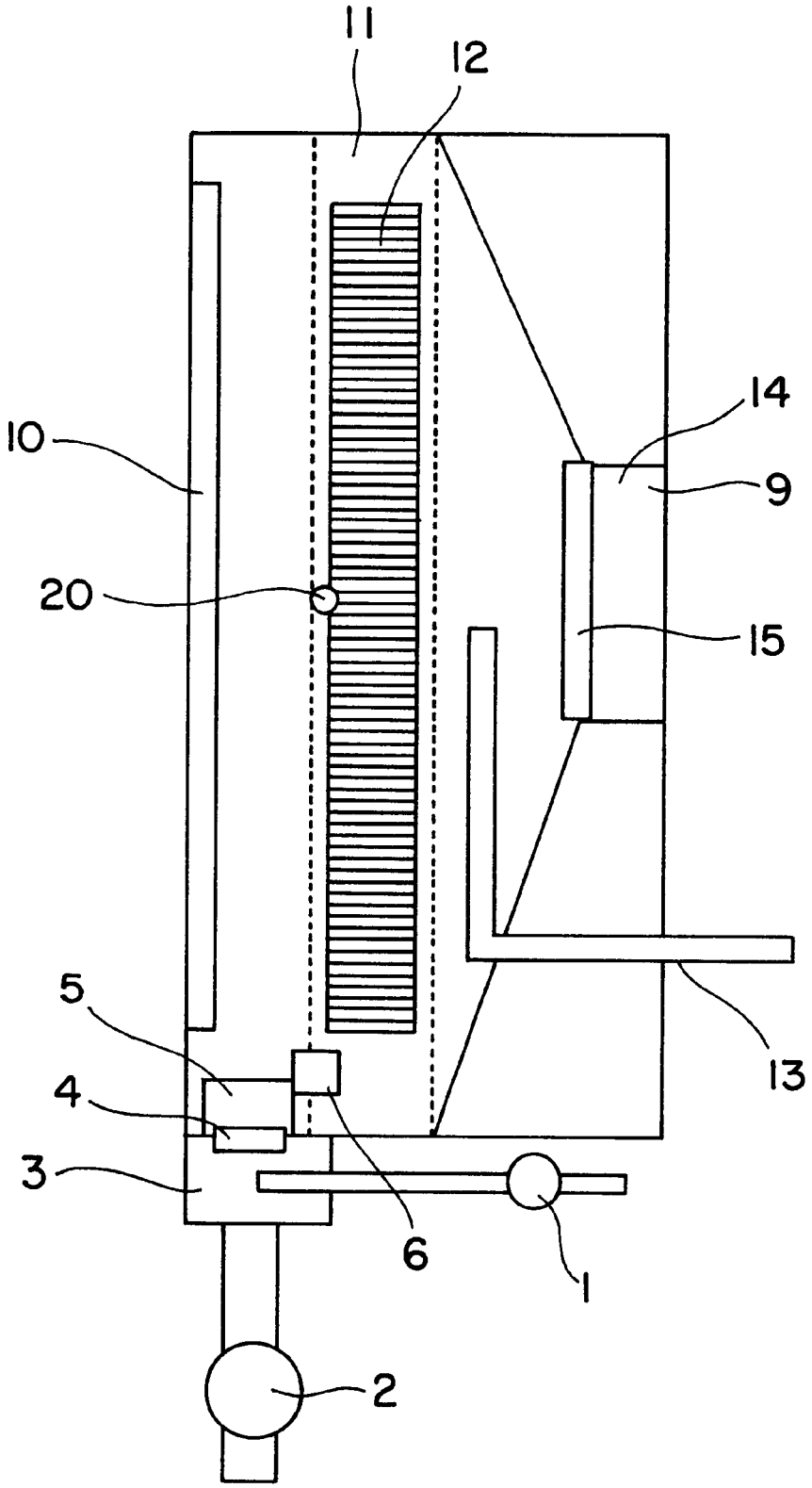
FIG. 2 shows in cross section major parts of a catalytic combustion system according to an embodiment of the present invention.

Referring first to FIG. 2, there are cross-sectionally shown major parts of a first embodiment in accordance with the present invention. An example. structure of the first embodiment of the present invention will be described along with its operation. In a premix chamber 3, a fuel gas, supplied from a fuel supply valve 1, is mixed with air supplied from an air supply valve 2, and is delivered, through a gaseous mixture inlet port 4, to a preheat burner 5. The fuel-air mixture is ignited by an ignition unit 6, thereby forming a flame at the preheat burner 5. High-temperature exhaust gases as a result of such flame formation pass through a first catalyst body 12 as a primary combustion chamber while at the same time heating the first catalyst body 12, wherein the first catalyst body 12 is disposed in a primary combustion chamber 11 and comprises a porous base material which has numerous communicating holes and on which either Pt or Rh is supported. Alternatively, an oxidation catalyst, which contains therein Pt or Rh as its major constituent, may be supported. Thereafter, the mixture is mixed with a gaseous mixture supplied from a supply part 13 for the supply of a secondary gaseous mixture or air, passes through a secondary combustion chamber 14 located downstream, and is discharged from an exhaust port 9. When the first catalyst body 12 is heated up to arrive at its catalytic activity temperature for the fuel, fuel supply is temporarily stopped by the fuel supply valve 1 to extinguish the flame formed at the preheat burner 5. It is arranged such that by an immediate resupply of fuel, catalytic combustion commences. The first catalyst body 12 is placed in a high temperature state, wherein the first catalyst body 12 radiates heat through a glass 10 located upstream of the first catalyst body 12 and in face-to-face arrangement therewith, while at the same time radiating heat in the form of exhaust gas to perform application of heat, heating, and drying.

Here, if given conditions are satisfied, then a mixture of a fuel gas and air, both of which are fed into the premix chamber 3, has an excess air ratio of less than 1, and the first catalyst body 12 is in a lack-of-air condition to some extent, in other words the first catalyst body 12 is in a reducing atmosphere. Accordingly, combustion exhaust gases at this stage contain therein (i) unburned fuel gases, (ii) CO, $H_2$, various hydrocarbons as partial oxidation products, and (iii) $CO_2$, water, and $N_2$ which are complete combustion products. The supply part 3 supplies specific amounts of air to the exhaust gases which have passed through the first catalyst body 12 in the foregoing atmosphere. Preferably, the amount of air is controlled such that the excess air ratio is not less than 1 at the inlet port of the secondary combustion chamber 14, whereby complete combustion can be achieved in the secondary combustion chamber 14. As shown in the FIG. 2 structure, a burner port 15 is provided within the secondary combustion chamber 14 (the secondary combustion chamber is made up of the burner port 15 and other structural components). The burner port 15 is ignited by ignition means (not shown) to form a flame, whereby unburned products and partial oxidation products are completely burned. As a result, the exhaust port 9 discharges clean, completely-burned exhaust gases.

Additionally, it becomes possible to instantly achieve complete combustion of unburned products and partial oxidation products by simultaneous flame formation at the preheat burner 5 and the burner port 15. Although it is sufficient for the supply part 13 (which is operable to supply a secondary gaseous mixture or air) to provide only air, it may provide a mixture of a fuel containing an excessive amount of air and air. It is also possible to provide an additional supply of fuel sufficient enough to maintain complete combustion in the secondary combustion chamber 14.

It is preferred that a catalyst constituent, that is supported on the first catalyst body 12 which is used under such conditions, is at least Pt or Rt. Alternatively, the catalyst constituent can be an oxidation catalyst containing therein either Pt or Rh as its major constituent. In these cases, control of the heat deterioration and expansion of the turn down ratio (TDR) can be obtained at the same time. By "containing Pt or Rh as a major constituent for an oxidation catalyst", what is meant here is that the oxidation catalyst contains at least either Pt or Rh as an active constituent that is a major contributor to catalytic reactions.

Figure 5:
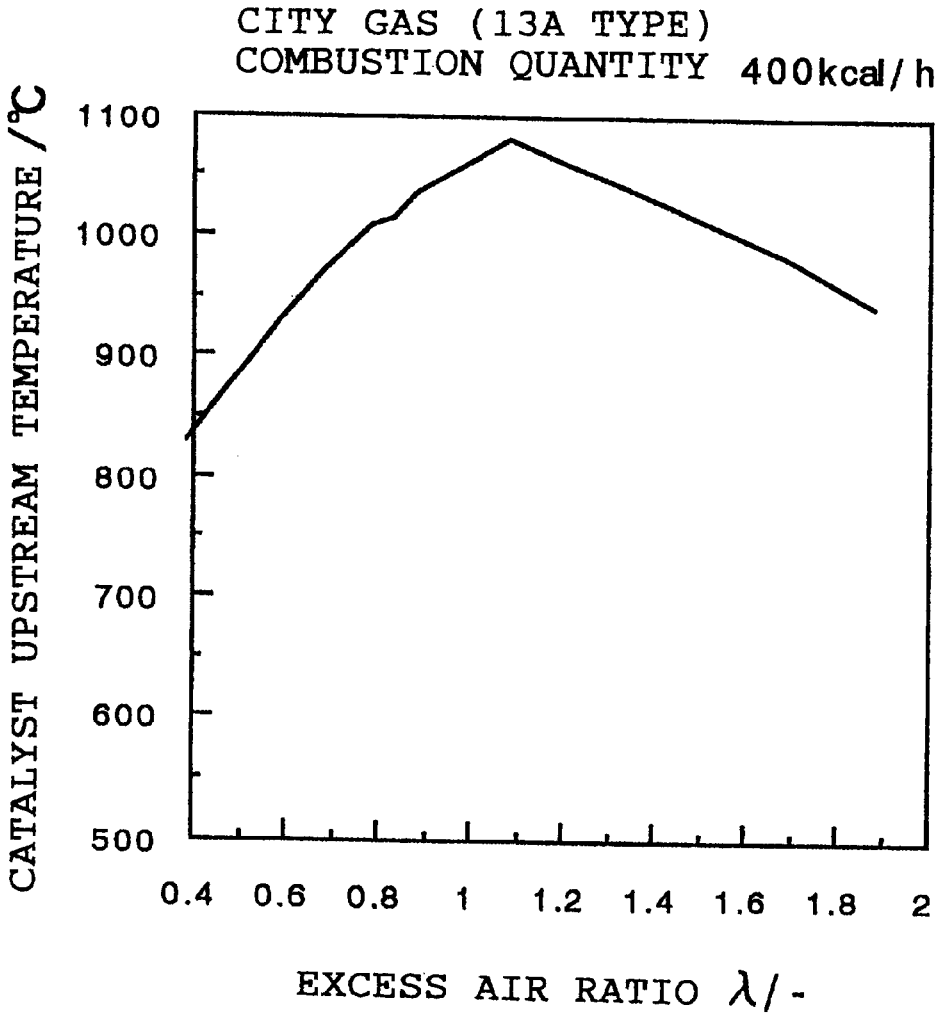
FIG. 5 graphically shows the $\lambda$ dependency of catalyst upstream temperature at a fixed quantity of combustion shown in EMBODIMENT 1 of the present invention, where λ represents the excess air ratio.

In the present invention, the excess air ratio ($\lambda$) of gases being supplied to the first catalyst body is set at less than 1 as follows. The excess air ratio $\lambda$ is varied under the condition in which the quantity of combustion remains constant, wherein a specific spot, at which the peak catalyst upstream temperature (often represented by the upstream temperature) reaches a maximum, is determined as a position where the excess air ratio is in the vicinity of 1, and it is arranged such that combustion is made to take place in zones in which the excess air ratio falls below 1. Generally, in the case of catalyst combustion employing either Pt or an oxidation catalyst containing therein Pt as a major catalytic reaction contributor, if the excess air ratio $\lambda$ is varied under the condition in which the quantity of combustion remains constant, the peak catalyst temperature reaches a maximum in the vicinity of a spot at which the excess air ratio $\lambda=1$, as shown in FIG. 5. Accordingly, it becomes feasible to control the excess air ratio $\lambda$ to be less than 1 by timely variation in the excess air ratio $\lambda$ and by incorporation of an operation of monitoring catalyst upstream temperatures by means of a temperature sensor 20 shown in FIG. 2 or the like. Detailed effects of this structure will be described later.

Embodiment 2

Figure 3:
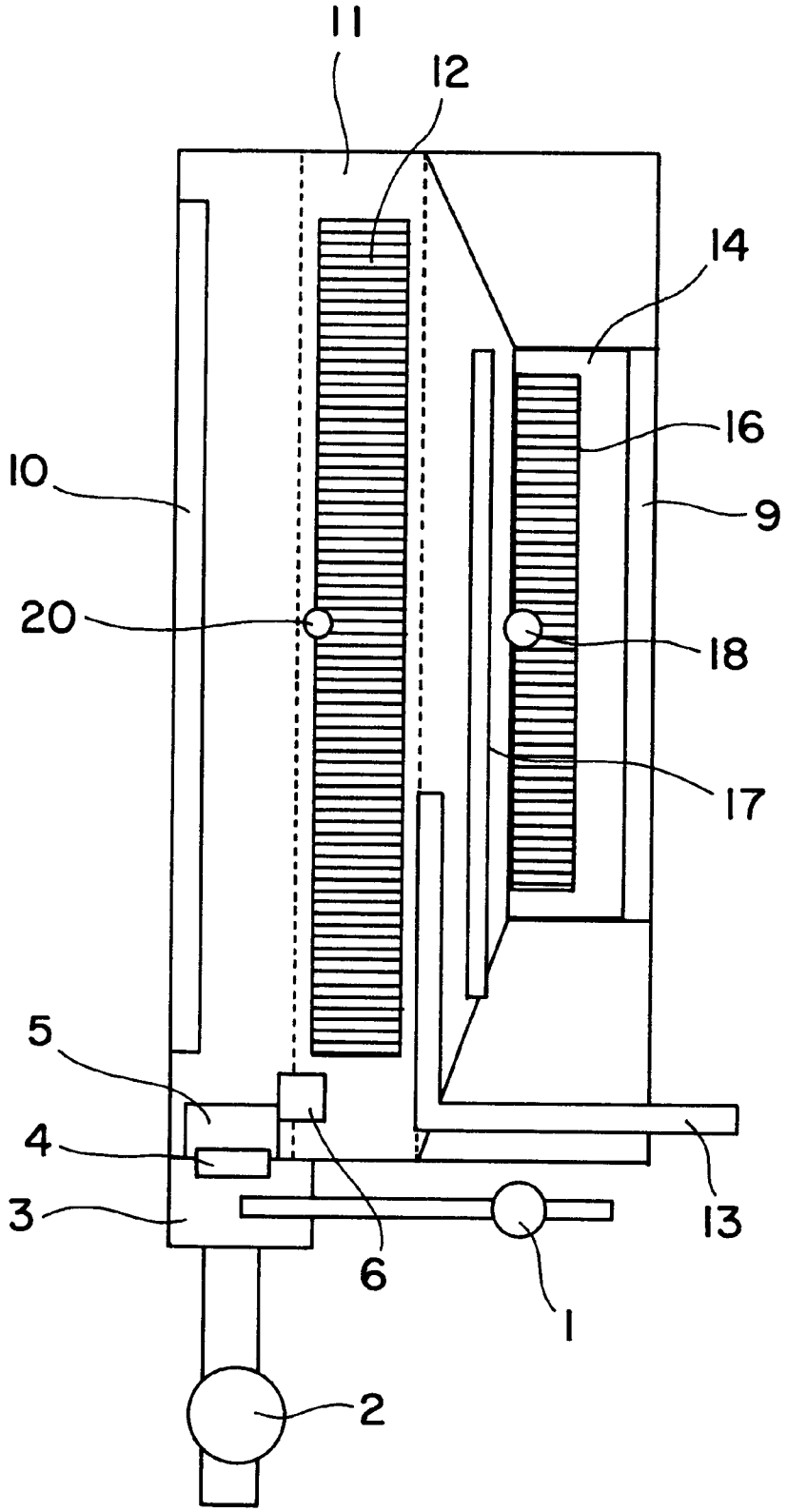
FIG. 3 shows in cross section major parts of a catalytic combustion system according to another embodiment of the present invention.

A second embodiment of the present invention is similar in basic structure as well as in operation to the above-described first embodiment. However, the second embodiment is different from the first embodiment in that the second embodiment has a secondary combustion chamber 14 different in internal structure from the one described in the first embodiment. Accordingly, the second embodiment will be described focussing on structural differences between the secondary combustion chambers 14 of the first and second embodiments, along with its operation. FIG. 3 depicts in cross section major parts of the second embodiment of the present invention. Disposed in the secondary combustion chamber 14 is a second catalyst body 14 as a secondary combustion chamber. The second catalyst body 14 comprises a ceramic honeycomb that supports thereon Pd. An electric heater 17 is provided in the vicinity of an upstream surface of the second catalyst body 14. Further, disposed in the vicinity of the second catalyst body 14 is a temperature sensor 18.

Figure 6:
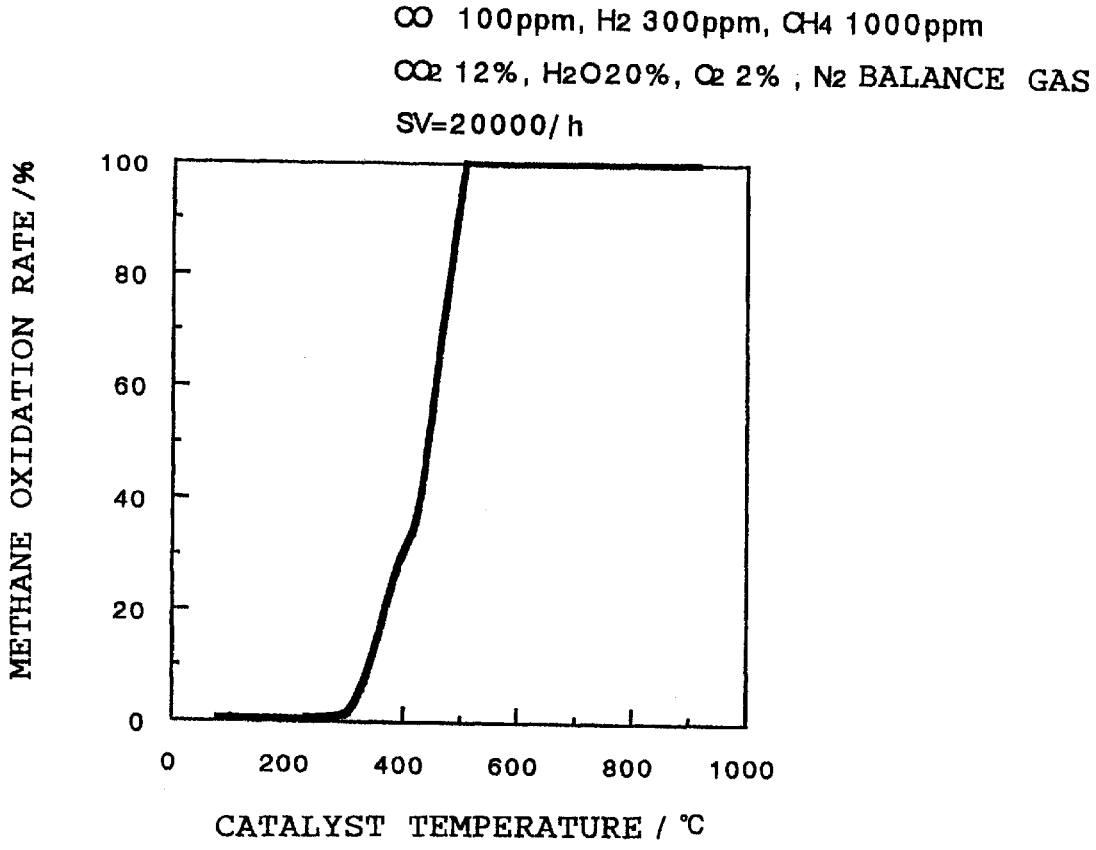
FIG. 6 graphically shows the temperature dependency of methane oxidation activity for a second catalyst used in one example of the present invention.

In the above-described structure, exhaust gases containing therein unburned components reach the second catalyst body 16 during constant combustion, as in the first embodiment. This makes it possible to cause catalytic combustion to take place without forming a flame. There will be produced no nitrogen oxide, and it is ensured that oxidation purification can be achieved without fail, even at dilute combustible-material concentrations. Additionally, the electric heater 17 is provided near the second catalyst body 16 for application of heat to the second catalyst body 16, which makes it possible to continuously maintain the temperature of the second catalyst body 16 above its active temperature. Particularly, in the presence of methane (which is, of the hydrocarbon components, slow to react) in the form of fuel or unburned components, it becomes necessary to maintain the temperature of the second catalyst body 16 above about 500 degrees centigrade, which can be supposed from the temperature dependency of methane oxidizing activity graphically shown in FIG. 6. However, by virtue of the provision of the electric heater 17, it is possible to control the temperature of the second catalyst body 16, regardless of the quantity of combustion in the first catalyst body 12. It is therefore guaranteed that clean exhaust gases are obtained constantly. The present embodiment employs the above-described heating means capable of electrical heating, which is however not considered to be restrictive. Alternatively, flame heating means can be employed which is separately provided in the vicinity of the upstream side of the second catalyst body 16.

It is possible to cause complete combustion to take place by setting the excess air ratio above 1 under specific conditions, that is, the temperature of the second catalyst body falls below 500 degrees centigrade and the degree of purification is insufficient (i.e., the combustion ratio is less than 95%), for example, in a case where the quantity of combustion is low.

By control of the percentage of reactive fuel by making a variation in the excess air ratio $\lambda$ of a gaseous mixture that is supplied to the primary combustion chamber 11, the temperature of the first catalyst body 12 is controlled while maintaining the temperature of the second catalyst body 16 above 500 degrees centigrade for the realization of secondary combustion without the provision of the electric heater 18. In other words, if the quantity of combustion is low (i.e., the rate of fuel supply is low) therefore lowering the temperature of the first and second catalyst bodies 12 and 16, then the excess air ratio $\lambda$ of a gaseous mixture with respect to the primary combustion chamber 11 is intentionally lowered for the purpose of increasing the percentage of unburned components in the primary combustion chamber 11, in order to increase the quantity of combustion taking place in the secondary combustion chamber 14. As a result of such arrangement, it becomes feasible to maintain the temperature of the second catalyst body 16 high. The same effects as above can be attained by increasing the excess air ratio $\lambda$ in the primary combustion chamber 11 while keeping the combustion quantity constant and by reduction—supplying a corresponding amount of air to such an increase in the primary combustion chamber 11. Alternatively, these effects can be obtained by reducing the excess air ratio $\lambda$ and by additionally supplying at least an amount of air proportional to such a reduction in the primary combustion chamber 11. In other words, if it is controlled such that the excess air ratio $\lambda$ of the primary combustion chamber 14 is relatively low, then the temperature of the first catalyst body 12 becomes relatively low. As a result, unburned components undergo complete combustion in the secondary catalyst chamber 16, thereby maintaining the temperature of the second catalyst body 16 high. On the other hand, if it is controlled such that the excess air ratio $\lambda$ of the primary combustion chamber 11 is relatively high, then the temperature of the primary combustion chamber 12 becomes relatively high and the second catalyst body 16 is also heated by exhaust gases, whereby the temperature of the second catalyst body 16 can be held above 500 degrees centigrade.

Such operations are applicable to the first embodiment of the present invention. At the time when the second catalyst body 16 is not heated up sufficiently (for example, at the flame preheating time of the first catalyst body 12), satisfactory purification of unburned components is difficult to attain even if the excess air ratio λ is set above 1 by an additional supply of air from the secondary air supply part 13. This problem can be dealt with as follows. A preheating operation is carried out using the electric heater 18 or a separately-provided heating burner until the time the second catalyst body 16 reaches a temperature sufficient for satisfactory purification, or the excess air ratio of a gaseous mixture that is supplied to the premix chamber 3 is set above 1 and means, such as application of heat by complete combustion flaming at the preheat burner 5, is employed to provide complete purification at the initial stage of combustion.

Here, the foregoing temperature sufficient for satisfactory purification is one (not less than about 200 degrees centigrade) at which not less than 95% of CO is oxidized or the concentration of CO contained in exhaust gases falls below 50 ppm. Preferably, the temperature is one (not less than 500 degrees centigrade) at which not less than 95% of fuel components are oxidized or the concentration of combustible components contained in exhaust gases falls below 1,000 ppm.

In the present embodiment, a catalyst that contains therein Pd as a major component (i.e., as a major catalytic reaction contributor) is used for the second catalyst body 16, which is however not considered to be restrictive. Any one of (i) a catalyst prepared by supporting a metal of the platinum group, which is superior in oxidation activity of methane, CO, and $H_2$ under air-excess conditions, on inorganic oxide, (ii) a transition metal catalyst, and (iii) a compound oxide catalyst can be selected.

Detailed effects of such a structure will be described later.

Embodiment 3

Figure 4:
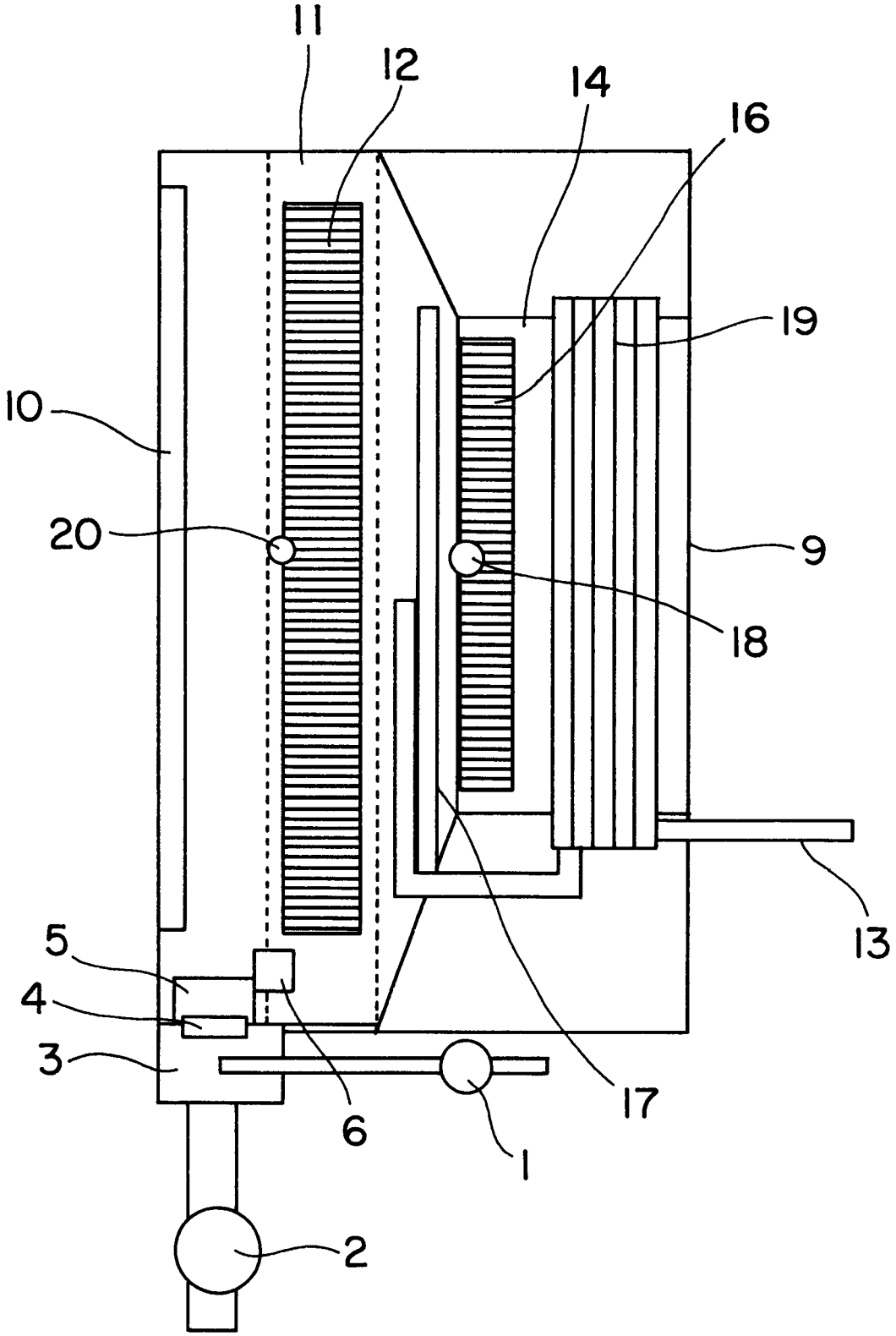
FIG. 4 shows in cross section major parts of a catalytic combustion system according to still another embodiment of the present invention.

A third embodiment of the present invention is identical in basic constitution as well as in operation with the second embodiment described above. The difference between these embodiments is that the third embodiment includes an exhaust heat recovery part 19 disposed in the secondary combustion chamber 11 or along the way from the secondary combustion chamber 11 to the exhaust port 9. Accordingly, focussing on such a difference, the third embodiment will be described along with its operation. Referring now to FIG. 4, there are shown in cross section major parts of the third embodiment of the present invention. The exhaust heat recovery part 19, which is disposed along the way from the secondary combustion chamber 14 to the exhaust port 9, collects heat from the secondary combustion chamber 14 and heat contained in exhaust gases while at the same time preheating air or a gaseous mixture supplied from the supply part 13 for the supply of secondary air or a gaseous mixture, whereby it becomes possible to considerably reduce the quantity of heat required for heating the second catalyst body 16.

EXAMPLES OF THE INVENTION

Example 1

A ceramic honeycomb (material: cordierite; 400 cells/inch$^2$; wall thickness: 0.15; Φ50; length: 20) was provided. The ceramic honeycomb was first impregnated in a wash coat slurry A prepared by addition of (a) Ce/BaO.$Al_2O_3$powder (100 g) prebaked at 1,000 degrees centigrade for one hour, (b) a salt of $Al(NO_3)_3.9H_2O^-$ (aluminium nitrate) (10 g), (c) water (130 g), and (d) an aqueous solution of Pt dinitrodiammine salt (2 g in terms of Pt ), was next dried, and was lastly baked at 500 degrees centigrade. In this way, the ceramic honeycomb supported thereon an equivalent to Pt3 g/L (i.e., the honeycomb bulk volume) to form the first catalyst body 12.

Subsequently, another ceramic honeycomb (material: cordierite; 400 cells/inch$^2$ equivalent; wall thickness: 0.15; Φ20; length: 10) was provided. This ceramic honeycomb was first impregnated in a wash coat slurry B prepared by addition of (a) active alumina powder (100 g) prebaked at 1,000 degrees centigrade for one hour, (b) a salt of $Al(NO_3)_3.H_2O$ (aluminium nitrate) (10 g), (c) water (130 g), and (d) an aqueous solution of Pd dinitrodiammine salt (2 g in terms of Pd), was next dried, and was lastly baked at 500 degrees centigrade. In this way, the ceramic honeycomb supported thereon an equivalent to Pd3 g/L to form the second catalyst body 16. This was followed by installing the first and second catalyst bodies 12 and 16 in the FIG. 3 catalytic combustion system. City gas (13A type) was used as a fuel. The excess air ratio λ of a pre-mix gas to be supplied to the primary combustion chamber 11 was set at 0.95. As to the supply of a premix gas or air from the supply port 13, it was arranged such that after an additional supply of premix gas or air to the secondary combustion chamber 14 from the supply port 13, the gaseous mixture had a total excess air ratio λ of 1.2. The temperature of the second catalyst body 16 was set constantly above 500 degrees centigrade by control of the electric heater 17.

Example 2

A metallic honeycomb (material: FeCrAl; 400 cells/inch$^2$ equivalent; wall thickness: 0.15; Φ50; length: 20) was provided. The metallic honeycomb was first impregnated in the same wash coat slurry A as used in EXAMPLE 1, was next dried, and was lastly baked at 500 degrees centigrade. In this way, the metallic honeycomb supported thereon an equivalent to Pt3 g/L to form the first catalyst body 12. This was followed by installation of the first catalyst body 12 thus formed, together with a second catalyst body 16 prepared in the same way as in EXAMPLE 1, on the FIG. 3 catalytic combustion system. Control of the excess air ratio of a premix gas to be supplied to the primary combustion chamber 11, control of the amount of a supply of air to the secondary combustion chamber 14, control of the temperature of the second catalyst body 16 were all exerted in the same way as in EXAMPLE 1.

Example 3

A first catalyst body 12 was formed in the same way as in EXAMPLE 1. The first catalyst body 12 was installed in the FIG. 2 catalytic combustion system. Like EXAMPLE 1, the excess air ratio of a primary gaseous mixture was 0.95. The quantity of combustion of the city gas supplied from the burner port 15 into the secondary combustion chamber 14 was 40 kcal/h. It was set such that a secondary gaseous mixture of a city gas and air had a total excess air ratio λ (=1.2) when mixed with exhaust gases from the primary combustion chamber 11,

Example 4

Figure 12:
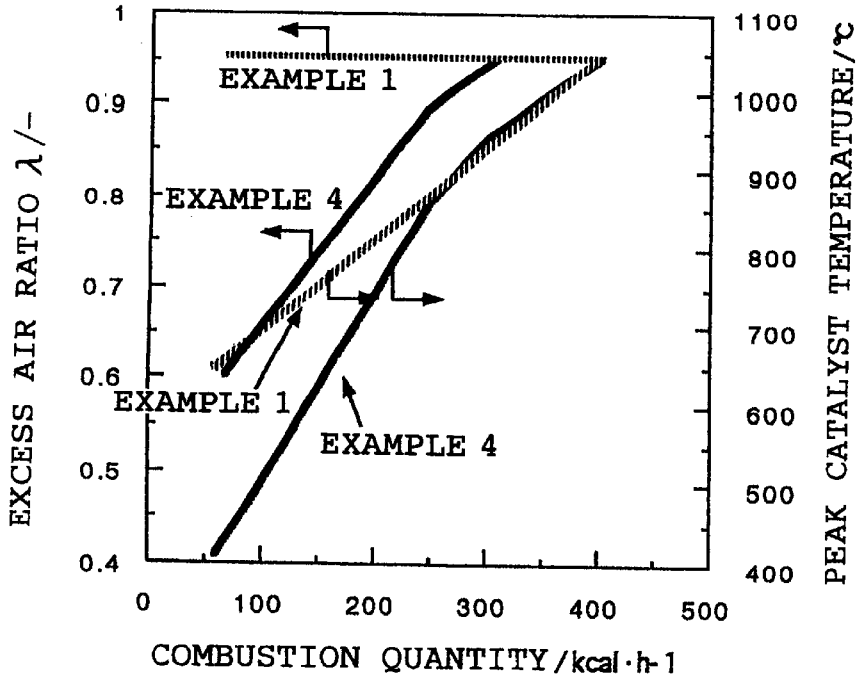
FIG. 12 graphically shows a relationship between the excess air ratio (which is controlled relative to the quantity of combustion) and the peak catalyst temperature in EXAMPLES 1 and 4 of the present invention.
Figure 13:
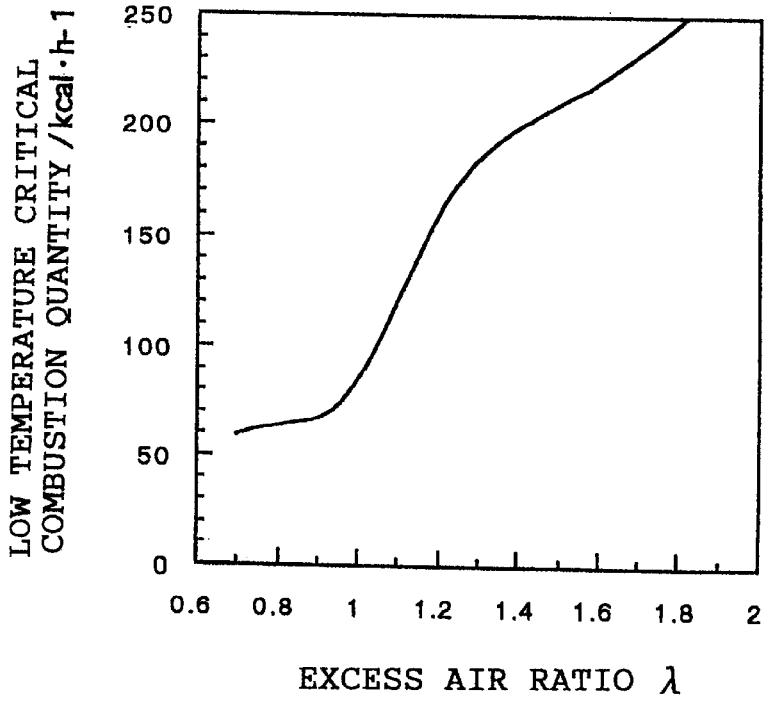
FIG. 13 graphically shows an excess air ratio versus low-temperature critical combustion quantity relationship.

In EXAMPLE 4, a catalytic combustion system, which is identical in structure with the one used in EXAMPLE 1, was employed. Both the amount of a supply of fuel and the amount of a supply of air were controlled such that in the primary combustion chamber 11, the excess air ratio λ was decreased as the combustion quantity was decreased, as shown in FIGS. 12 and 13. Control of the air supply amount for the secondary combustion chamber 14 was exerted such that the total excess air ratio λ after mixing with primary exhaust gases at the inlet port of the secondary combustion chamber 14 was 1.2.

Example 5

In EXAMPLE 5, a catalytic combustion system, which is identical in structure with the one used in EXAMPLE 1, was employed. The quantity of combustion of the city gas (13A type) supplied to the primary combustion chamber 11 was fixed at 400 kcal/h, and the amount of a supply of air to the primary combustion chamber 11 was increased or decreased. Control of the air supply amount for the secondary combustion chamber 14 was exerted such that the total excess air ratio λ after mixing with primary exhaust gases at the inlet port of the secondary combustion chamber 14 was 1.2.

Example 6

In EXAMPLE 6, a catalytic combustion system, which is identical in structure with the one used in EXAMPLE 1, was employed. In the case the amount of a supply of the city gas (13A type) was less than 180 kcal/h, the air supply amount was controlled such that the excess air ratio λ of a gaseous mixture being supplied to the primary combustion chamber 11 was 1.2. If the supply amount exceeded 180 kcal/h, the air supply amount was controlled such that the excess air ratio λ was 0.95, and that control of the air supply amount for the secondary combustion chamber 14 was exerted such that the total excess air ratio λ after mixing with primary exhaust gases at the inlet port of the secondary combustion-chamber 14 was 1.2.

Example 7

In EXAMPLE 7, a catalytic combustion system, which is identical in structure with the one used in EXAMPLE 1, was employed. The first catalyst body 12 was preheated by flame formed under given conditions (i.e., the city gas (13A type)=400 kcal/h; the excess air ratio λ=1.2) until the moment the temperature sensor 18 detected that the upstream temperature of the second catalyst body 16 increased to 200 degrees centigrade. After such detection by the temperature sensor 18, the air supply amount was controlled so as to provide an excess air ratio λ of 0.95 for the primary combustion chamber 11. Control of the excess air ratio of a premix gas supplied during the steady time to the primary combustion chamber 11, control of the amount of a supply of air to the secondary combustion chamber 14, and control of the temperature of the second catalyst body 16 were all exerted in the same way as in EXAMPLE 1.

Example 8

Figure 7:
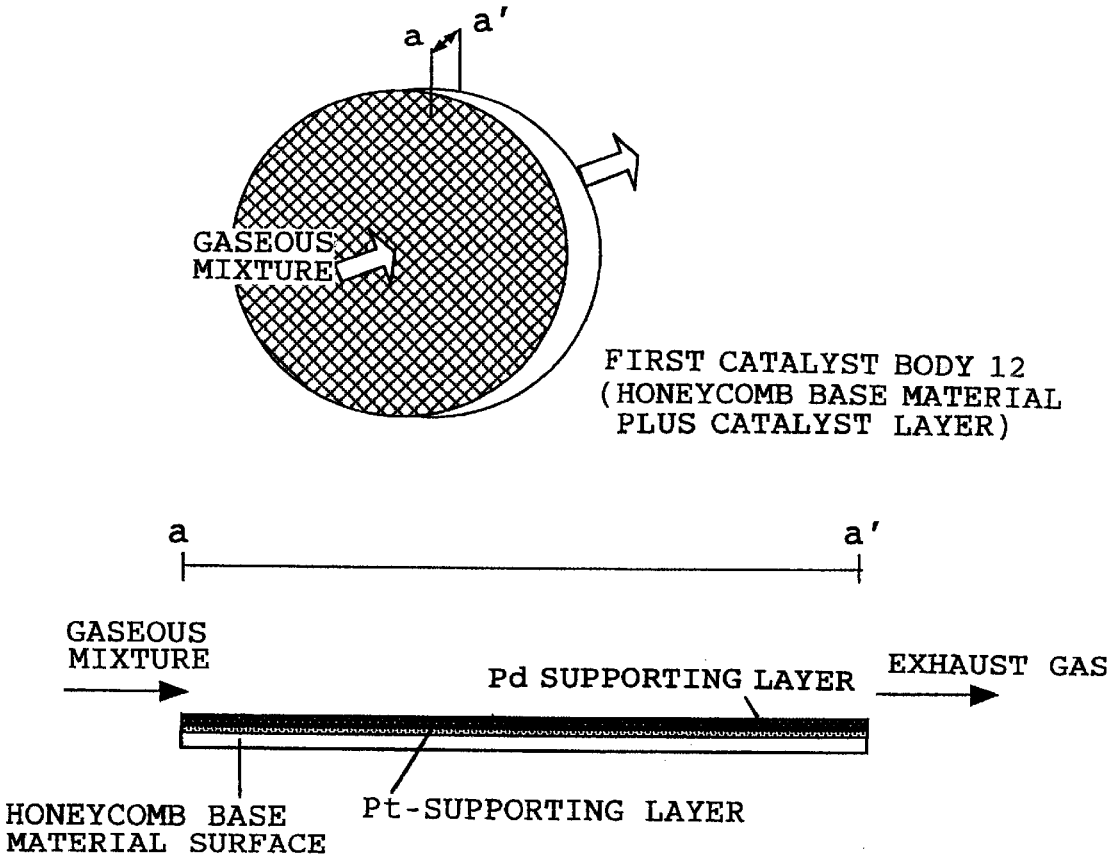
FIG. 7 shows in cross section a first catalyst body used in Example 8 of the present invention.

A ceramic honeycomb (material: cordierite; 400 cells/inch$^2$ equivalent; wall thickness: 0.15; Φ50; length: 20) was provided. The ceramic honeycomb was first impregnated in the same wash coat slurry A as used in EXAMPLE 1, was next dried, and was lastly baked at 500 degrees centigrade, wherein an equivalent to Pt2 g/L was supported. Thereafter, the ceramic honeycomb was first impregnated in the same wash coat slurry B as used in EXAMPLE 1, was next dried, and was lastly baked at 500 degrees centigrade. As a result, an equivalent to Pd1 g/L was lamination-supported on the Pt supporting layer to form a first catalyst body 12, as shown in FIG. 7. This was followed by installation of the first catalyst body 12 thus formed and the second catalyst body 16 formed in the same way as in EXAMPLE 1, in the FIG. 3 catalytic combustion system. Control of the excess air ratio of a premix gas that is supplied to the primary combustion chamber 11, control of the amount of a supply of air to the secondary combustion chamber 14, and control of the temperature of the second catalyst body 16 were all exerted in the same way as in EXAMPLE 1.

Example 9

Figure 8:
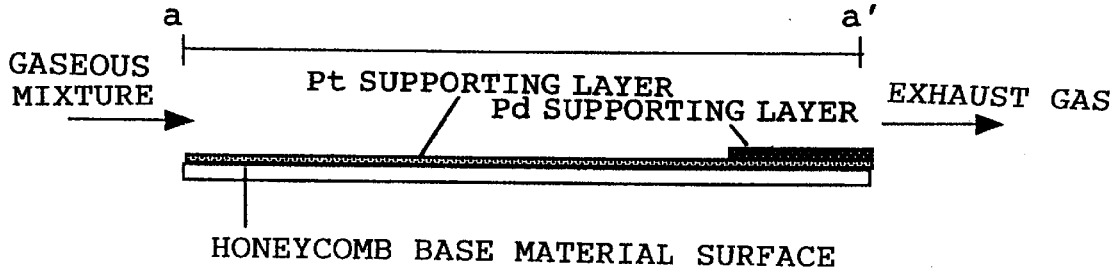
FIG. 8 shows in cross section a first catalyst body used in EXAMPLE 9 of the present invention.

A ceramic honeycomb (material: cordierite; 400 cells/inch$^2$ equivalent; wall thickness: 0.15; Φ50; length: 20) was provided. The ceramic honeycomb was first impregnated in the same wash coat slurry A as used in EXAMPLE 1, was next dried, and was lastly baked at 500 degrees centigrade, wherein an equivalent to Pt2.8 g/L was supported. Thereafter, a portion at one end of a surface of the ceramic honeycomb was first impregnated in the same wash coat slurry B as used in EXAMPLE 1, was next dried, and was lastly baked at 500 degrees centigrade. As a result, an equivalent to Pd0.2 g/L was partially (to the region about 3 mm from the end surface) lamination-supported on the Pt supporting layer to form a first catalyst body 12 as shown in FIG. 8. This was followed by installation of the first catalyst body 12 thus formed and the second catalyst body 16 formed in the same way as in EXAMPLE 1, in the FIG. 3 catalytic combustion system. Control of the excess air ratio of a premix gas that is supplied to the primary combustion chamber 11, control of the amount of a supply of air to the secondary combustion chamber 14, and control of the temperature of the second catalyst body 16 were all exerted in the same way as in EXAMPLE 1. It is to be noted that Rh can be used in place of Pd.

Example 10

A ceramic honeycomb (material: cordierite; 400 cells/inch$^2$ equivalent; wall thickness: 0.15; Φ50; length: 20) was provided. The ceramic honeycomb was first impregnated in a wash coat slurry C prepared by addition of (a) $ZrO_2$ powder (100 g) prebaked at 500 degrees centigrade for one hour, (b) water (100 g), and (c) an aqueous solution of Pt dinitrodiammine salt (2 g in terms of Pt), was next dried, and was lastly baked at 500 degrees centigrade, wherein an equivalent to Pt3 g/L (i.e., the honeycomb bulk volume) was supported thereby to form a first catalyst body 12. This was followed by installation of the first catalyst body 12 thus formed and the second catalyst body 16 formed in the same way as in EXAMPLE 1, in the FIG. 3 catalytic combustion system. Control of the excess air ratio of a premix gas that is supplied to the primary combustion chamber 11, control of the amount of a supply of air to the secondary combustion chamber 14, and control of the temperature of the second catalyst body 16 were all exerted in the same way as in EXAMPLE 1.

Compare Example 1

Figure 1:
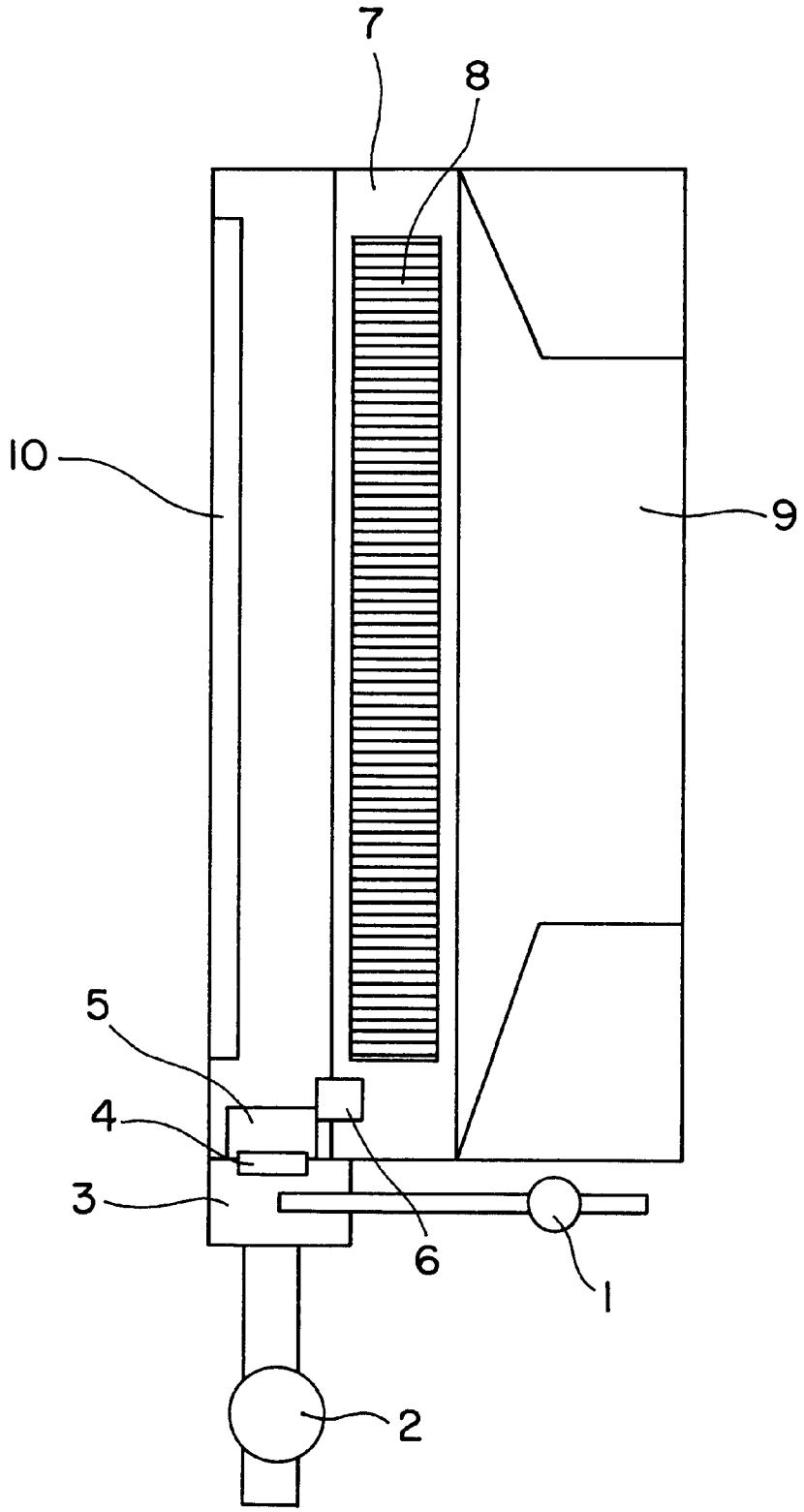
FIG. 1 PRIOR ART
FIG. 1 shows in cross section major parts of a conventional catalytic combustion system.

A Pt-supporting catalyst body 8 prepared in the same way as in EXAMPLE 1 was installed in the FIG. 1 catalyst combustion system. The excess air ratio was fixed at 1.2, that is, λ=1.2.

Compare Example 2

A ceramic honeycomb (material: cordierite; 400 cells/inch$^2$ equivalent; wall thickness: 0.15; Φ50; length: 20) was provided. The ceramic honeycomb was first impregnated in a wash coat slurry D prepared by addition of (a) $Ce/BaO.Al_2O_3$ powder (100 g) prebaked at 1,000 degrees centigrade for one hour, (b) a salt of $Al(NO_3)_3.9H_2O$ (aluminium nitrate) (10 g), (c) water (130 g), and (d) an aqueous solution of Pd dinitrodiammine salt (2 g in terms of Pd), was next dried, and was lastly baked at 500 degrees centigrade, wherein an equivalent to Pd3 g/L was supported thereby to form a first catalyst body 8. Like COMPARE EXAMPLE 1, the catalyst body 8 was installed in the FIG. 1 catalyst combustion system and the excess air ratio λ was set. at 1.2.

Compare Example 3

In COMPARE EXAMPLE 3, both a first catalyst body 12 (which was formed in the same way as the catalyst body 8 in COMPARE EXAMPLE 2) and a second catalyst body 16 (which was formed in the same way as in EXAMPLE 1) were installed in the FIG. 3 catalytic combustion system. Control of the excess air ratio of a premix gas that is supplied to the primary combustion chamber 11, control of the amount of a supply of air to the secondary combustion chamber 14, and control of the temperature of the second catalyst body 16 were all exerted in the same way as in EXAMPLE 1.

Compare Example 4

A ceramic honeycomb (material: cordierite; 400 cells/$inch^2$ equivalent; wall thickness: 0.15; Φ50; length: 20) was provided. The ceramic honeycomb was first impregnated in a wash coat slurry E prepared by addition of (a) $Ce/BaO.Al_2O_3$ powder (100 g) prebaked at 1,000 degrees centigrade for one hour, (b) a salt of $Al(NO_3)_3.9H_2O$ (aluminium nitrate) (10 g), (c) water (130 g), (d) an aqueous solution of Pd dinitrodiammine salt (0.7 g in terms of Pd), and (e) an aqueous solution of Pt dinitrodiammine salt (1.3 g in terms of Pt), was next dried, and was lastly baked at 500 degrees centigrade, wherein an equivalent to Pd1 g/L and an equivalent to Pt2 g/L were supported at the same time to form a first catalyst body 12. Next, as in EXAMPLE 1, a second catalyst body 16 was formed. Both the first catalyst body 12 and the second catalyst body 16 were installed in the FIG. 3 catalyst combustion system. Control of the excess air ratio of a premix gas that is supplied to the primary combustion chamber 11, control of the amount of a supply of air to the secondary combustion chamber 14, and control of the temperature of the second catalyst body 16 were all exerted in the same way as in EXAMPLE 1.

Compare Example 5

A Pt-supporting catalyst body 8 formed in the same way as the first catalyst body 12 of EXAMPLE 2 was installed in the FIG. 1 catalytic combustion system. The excess air ratio was fixed at 1.2, that is, λ=1.2.

For the above-described examples (EXAMPLES 1–10 and COMPARE EXAMPLES 1–5), for example, the distribution of catalyst layer temperatures in the direction of flow, the preheat time until catalytic combustion takes place, the constituent of exhaust gases after preheat and at steady time, the minimum quantity of combustion (the low temperature critical combustion quantity) capable of providing continuous combustion were examined. The catalyst layer temperature distribution in the direction of flow was measured by scanning with a thermocouple. The preheat time was determined as follows, that is, after preheating was carried out for a given length of time, whether catalytic combustion took place was detected. The constituent of exhaust gases was measured by an HC (total hydrocarbon) —CO—$CO_2$ meter. Finally, the low temperature critical combustion quantity was determined under given conditions, that is, (i) the excess air ratio λ was fixed and (ii) there were made variations in the quantity of combustion, with confirmation that combustion went on for six hours, for EXAMPLES 1–3 and 6–9 and COMPARE EXAMPLES 1–4. With regard to EXAMPLE 4, the quantity of combustion was varied according to the foregoing method. Combustion life testing was performed on EXAMPLES 1, 2, 9, and 10 and COMPARE EXAMPLES 1–4, wherein the quantity of combustion (the amount of a supply of the city gas) in the test was set at 400 kcal/h in EXAMPLES 1 and 9 and COMPARE EXAMPLES 1–4, while it was set at 550 kcal/h in EXAMPLES 1, 2, and 10 and COMPARE EXAMPLE 5. Variations with time in catalyst upstream temperature were measured using a radiation thermometer.

Catalyst Upstream Temperature Variation with Time

Figure 9:
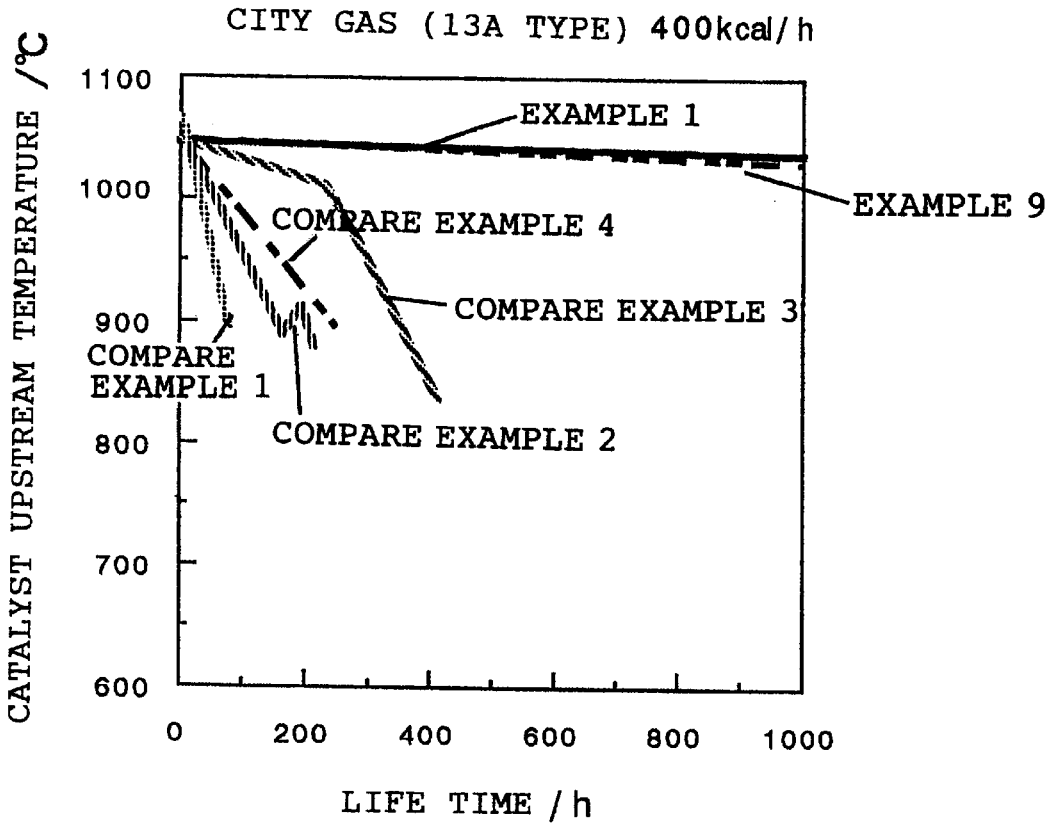
FIG. 9 graphically shows variations with time in the catalyst upstream temperature during life testing of EXAMPLES of the present invention and COMPARE EXAMPLES.
Figure 10:
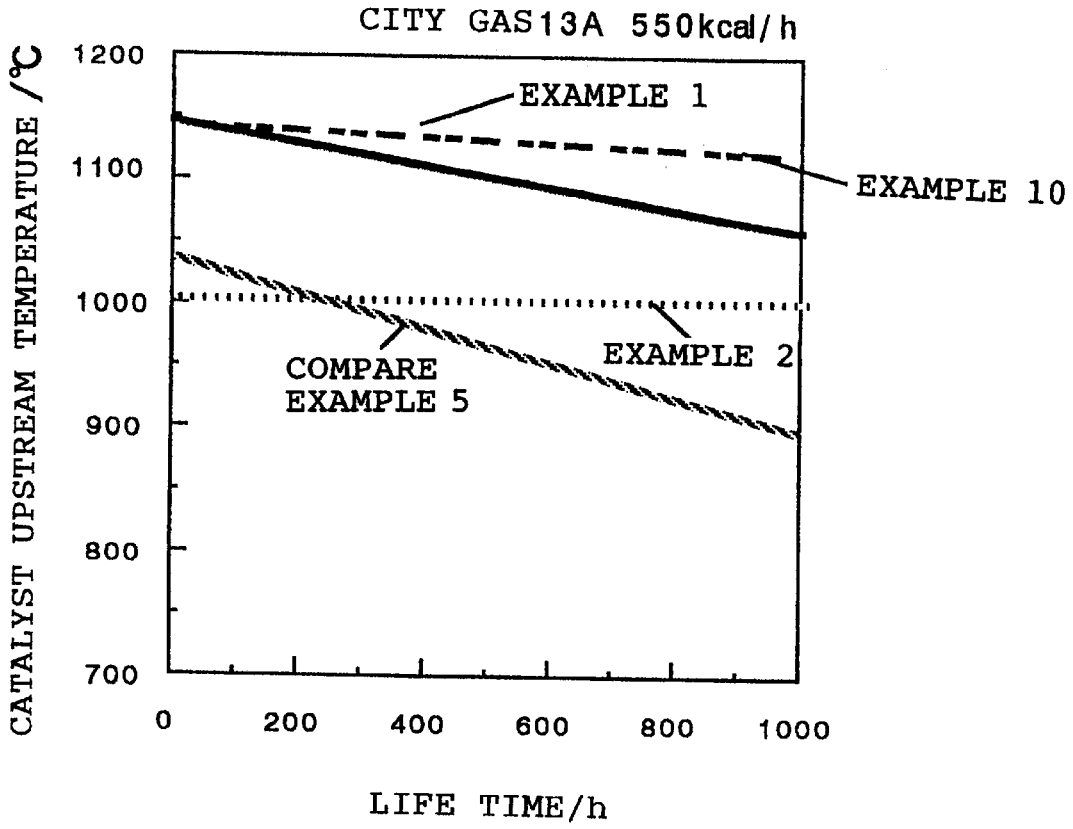
FIG. 10 graphically shows variations with time in the catalyst upstream temperature during life testing of EXAMPLES of the present invention and COMPARE EXAMPLE.

Referring now to FIGS. 9 and 10, there are shown variations with time in catalyst upstream temperature up to a maximum combustion life test time of 1,000 hours under respective conditions, for EXAMPLES 1, 2, 9, and 10 and COMPARE EXAMPLES 1–5. FIG. 9 shows the results at a combustion quantity of 400 kcal/h. COMPARE EXAMPLES 1 and 2 were tested at an excess air ratio of 1.2, and it was observed that the catalyst upstream temperature abruptly dropped from the early stages of the test and that obvious deterioration was detected. For COMPARE EXAMPLE 2, after an elapse of about 100 hours, it was observed that the catalyst temperature repeatedly increased and decreased. In addition, vibration phenomenon inherent in (or characteristic of) Pd was observed. On the other hand, for EXAMPLES 1 and 9, the first catalyst body 12 underwent combustion at an excess air ratio of less than 1, and it was proved that the degree of variation in activity was slight despite the fact that the initial catalyst upstream temperature was high (i.e., 1,050 degrees centigrade), and that Pt was unlikely to deteriorate in the reducing state. However, for the case of COMPARE EXAMPLE 3, the testing thereof was made at an excess air ratio of less than 1 using the first catalyst body 12 that contains therein Pd as a major constituent, and it was found that the catalyst upstream temperature extremely dropped by an elapse of 500 hours. Likewise, testing was made on particles of other individual precious metal catalysts, and Pt was found to be the best material for providing improved effects of the heat-resistant life at excess air ratios of less than 1. The result shows that Rh was inferior to Pt under the condition of the present example, that is, λ (excess air ratio)=0.95. However, Rh was proved to exhibit the same heat-resistant life performance as Pt at a lower excess air ratio. This means that either the use of Pt or Rh in a combustion chamber or the use of an oxidation catalyst containing therein Pt or Rh as its major constituent in a combustion chamber provides improved effects of the heat-resistant life at excess air ratios of less than 1. COMPARE EXAMPLE 4, in which Pt and Pd were mixed together, was proved to be inferior for durability in comparison with single use of Pd.

FIG. 10 shows respective results of the combustion life testing for EXAMPLES 1, 2, and 10 and COMPARE EXAMPLE 5, in which the quantity of combustion was increased up to 550 kcal/h. In EXAMPLES 1 and 10 each employing a honeycomb of cordierite, the initial catalyst upstream temperature reached 1,150 degrees centigrade. In the case of EXAMPLE 1, the catalyst upstream temperature dropped about 100 degrees centigrade by an elapse of 1,000 hours, while on the other hand, for the case of EXAMPLE 10, the catalyst upstream temperature dropped only about 50 degrees centigrade. In EXAMPLE 1, $Al_2O_3$ with an additive of Ce.Ba was used as a support for Pt. EXAMPLE 10 is different from EXAMPLE 1 in that it employs $ZrO_2$ as a support for Pt. The reason for the difference in temperature drop between EXAMPLES 1 and 10 still remains unknown, but it is supposed that the difference concerns interactions of Pt with $ZrO_2$. The same effects were observed when using $CeO_2$ as a support for Pt. In the case of EXAMPLE 2 and COMPARE EXAMPLE 5 each using a metallic honeycomb, the initial catalyst upstream temperature was 1,000 degrees centigrade, in other words, the metallic honeycomb case is lower in initial catalyst upstream temperature than the cordierite honeycomb case by about 150 degrees centigrade. In COMPARE EXAMPLE 5, the catalyst upstream temperature dropped down to about 850 degrees centigrade. On the other hand, in EXAMPLE 2, the catalyst upstream temperature remained unchanged, that is, the catalyst upstream temperature was maintained at the same level as the initial level (about 1,000 degrees centigrade). Combustion at higher combustion loads (fuel supply amounts per unit area) was proved to be possible by (i) using oxidation-resistant metallic honeycombs superior in heat transfer in comparison with cordierite ones, (ii) supporting a catalyst containing therein Pt as its major constituent on that metallic honeycomb, and (ii) causing combustion to take place at an excess air ratio of less than 1.

Catalyst Layer Temperature Distribution in Flow Direction

Figure 11:
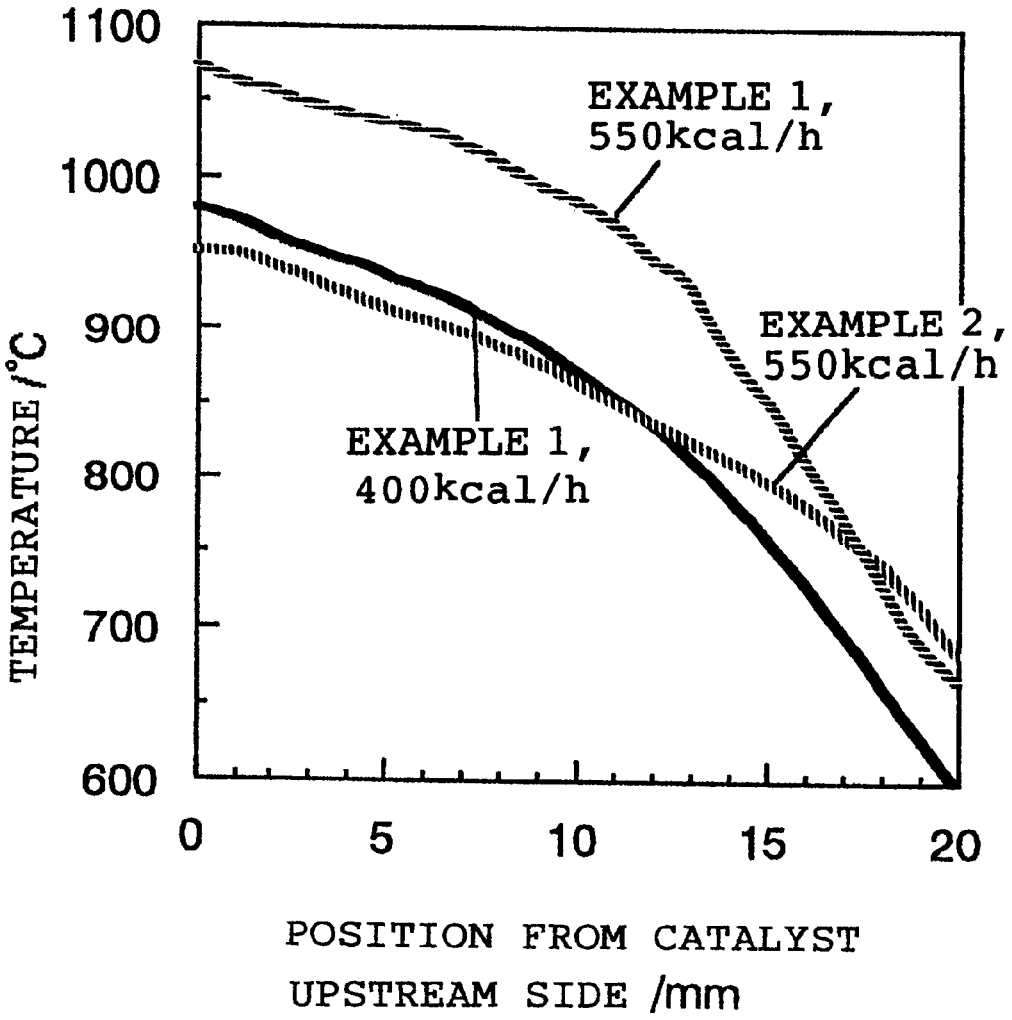
FIG. 11 graphically shows a distribution of temperatures in the direction of flow in EXAMPLES 1 and 2 of the present invention.

Referring to FIG. 11, there are shown the distribution of temperatures in the direction of flow in catalyst layers in EXAMPLES 1 and 2 at 550 kcal/h (also at 400 kcal/h for EXAMPLE 1). In EXAMPLE 2 employing a metallic honeycomb as a base material for the first catalyst body 12, the temperature distribution was proved to be gentle in comparison with EXAMPLE 1 that employed a cordierite honeycomb. That is to say, use of a metallic honeycomb makes it possible to provide a greater rise in downstream temperature while controlling local rising in peak temperature, in comparison with use of a cordierite honeycomb. The peak temperature of the second catalyst body 16 is directly affected by a downstream temperature of the first catalyst body 12, and in order to maintain the temperature of the second catalyst body above 500 degrees centigrade, it was proved to be effective to employ, as a base material, a material with a high heat transfer ratio of not less than 10 W/m·° C. such as metal used in said EXAMPLE 2 of the present invention in comparison to the cordierite (1~2W/m·° C.) generally used in the art. It is preferred that ferritic stainless steel containing 3% or more of Al, which is relatively superior in oxidation resistance, is used as a base material for metallic honeycombs. Ceramic base material (e.g., SiC), which has higher thermal conductivity than cordierite base material and which has higher thermal shock resistance than pure alumina sintered body, may be used.

Preheat Time

Examinations of the preheat time required for starting catalytic combustion at a combustion quantity of 250 kcal/h were performed and the results are shown in TABLE 1.

TABLE 1

| | MINIMUM PREHEAT TIME (sec) |
|---|---|
| EXAMPLE 1 | 70 |
| EXAMPLE 8 | 25 |
| EXAMPLE 9 | 30 |
| EXAMPLE 10 | 55 |
| COMPARE EXAMPLE 1 | 600 |
| COMPARE EXAMPLE 3 | 15 |
| COMPARE EXAMPLE 4 | 40 |

EXAMPLE 1 achieved a considerable reduction in the preheat time in comparison with COMPARE EXAMPLE 1, although the first catalyst body 12 of EXAMPLE 1 and the catalyst body 8 of COMPARE EXAMPLE 1 were identical in composition with each other. The reason may possibly be supposed as follows. That is, in spite of the fact that the first catalyst body was preheated at about the same preheat rate as the catalyst body 8, or in spite of the fact that the quantity of actual combustion was greater in COMPARE EXAMPLE 1 than in EXAMPLE 1, there was made improvement in on-catalyst reactivity by a reducing atmosphere thereby making it possible to start catalytic combustion in a shorter time. The use of the first catalyst body 12 formed by lamination of Pd and Pt layers made it possible to provide a further reduced preheat time, as proved by EXAMPLES 8 and 9. The result of COMPARE EXAMPLE 3 shows that Pd independently makes it possible to start catalyst combustion earlier than Pt of EXAMPLE 1, even in the reducing atmosphere. With regard to the combustion life, neither COMPARE EXAMPLE 3 (Pd independence) nor COMPARE EXAMPLE 4 in which Pt and Pd coexisted in the same layer was sufficient. Accordingly, as in EXAMPLES 8 and 9 of the present invention, the use of the first catalyst body 12 formed by lamination of Pd and Pt layers makes it possible to provide both a longer combustion life and a shorter preheat time. The same effects were attained by using Rh. Additionally, as shown in FIG. 8, partial formation of either a Pd layer or Rh layer at a downstream side where temperature is low and the degree of deterioration is too little is advantageous for combustion life improvement and cost saving.

Low Temperature Critical Combustion Quantity

Measurements of the low temperature critical combustion quantity (LTCCQ) in EXAMPLES 1 and 2 of the present invention and COMPARE EXAMPLES 1–3 were carried out and the results are shown in TABLE 2.

TABLE 2

| | LTCCQ (kcal/h) |
|---|---|
| EXAMPLE 1 | 60 |
| EXAMPLE 2 | 100 |
| COMPARE EXAMPLE 1 | 150 |
| COMPARE EXAMPLE 3 | 60 |

With regard to the low temperature critical combustion quantity (LTCCQ), EXAMPLE 1 of the present invention and COMPARE EXAMPLE 3 were the lowest of all the examples tested, and the conceivable reason for this is that (i) the velocity of flow was diminished by reduction of the excess air ratio and especially, (ii) Pt and Pd were made reductively active or combustion mechanisms differed. Likewise, also in EXAMPLE 2 which employed a metallic base material, the low temperature limit was remarkably lowered in comparison with COMPARE EXAMPLE 4 identical in structure with EXAMPLE 2, at an excess air ratio $\lambda$ of 1.2. That is, it is conceivable that TDR can be expanded by combustion at an excess air ratio of less than 1.

Next, there will be made a comparison between EXAMPLE 1 and EXAMPLE 4 of the present invention. In EXAMPLE 4, as shown in FIG. 12, the excess air ratio at the inlet port of the primary combustion chamber 11 was controlled so as to decrease as the quantity of combustion decreased, as a result of which the percentage of unburned components increased as the combustion quantity decreased, and such unburned components were burned in the second catalyst body 16. Because of this, at a lower quantity of combustion in comparison with EXAMPLE 1, the upstream temperature of the first catalyst body 12 dropped while on the other hand the temperature of the second catalyst body 16 increased. By the use of such control, it becomes possible to provide purification of unburned components and CO without the provision of heating means such as a heater. The low temperature critical combustion quantity in the EXAMPLE 4 is 60 kcal/h which is the same as in the EXAMPLE 1 while the catalyst upstream temperature of EXAMPLE 4 was low in comparison to in EXAMPLE 1. The reason is that in EXAMPLE 4 combustion ratio and the catalyst upstream temperature are lower because excess air ratio at the inlet of the first combustion chamber 11 under 60 kcal/h in comparison to in EXAMPLE 1, however the low temperature critical combustion quantity in EXAMPLE 4 decreases as the excess air ratio λ decreases as the FIG. 13.

Figure 14:
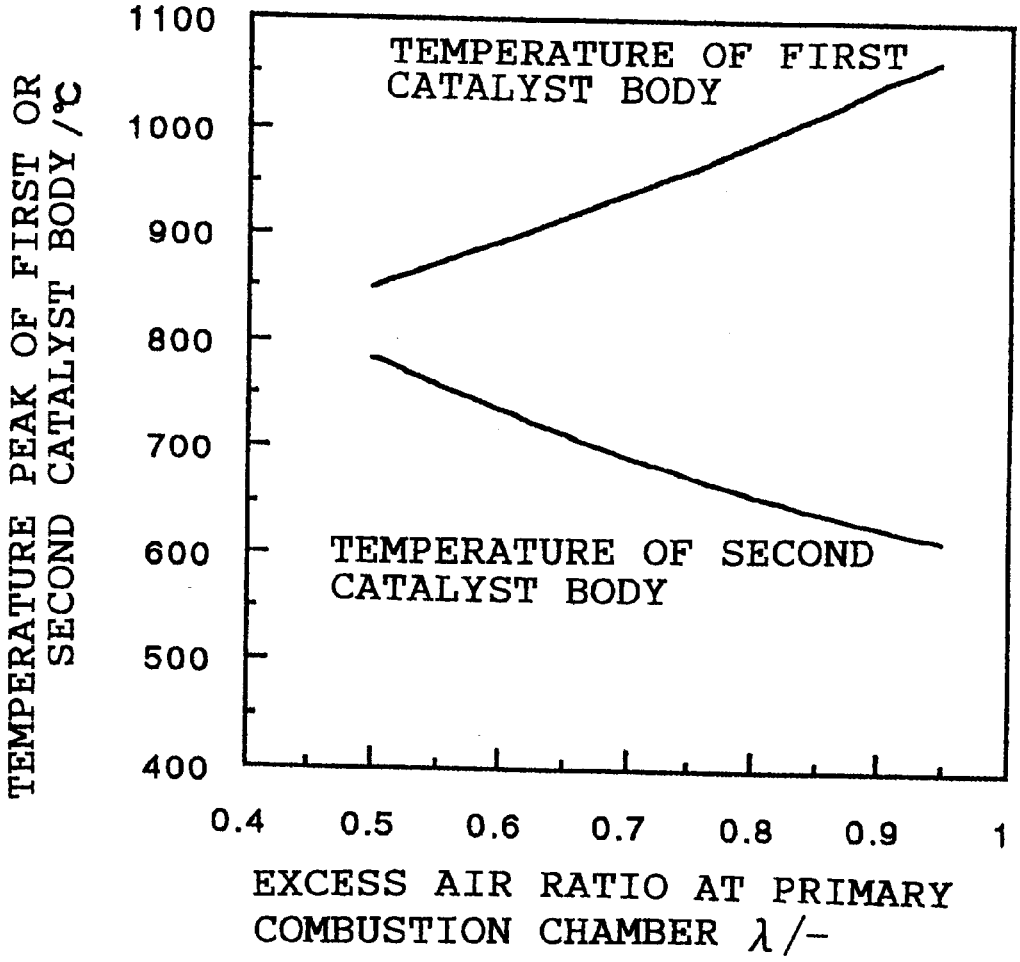
FIG. 14 graphically shows the excess air ratio dependency of peak temperatures of first and second catalyst bodies in EXAMPLE 5 of the present invention.

In EXAMPLE 5, the combustion quantity was made to remain approximately constant (at 400 kcal/h), and both the actual combustion quantity and the catalyst temperature in the first catalyst body 12 were controlled by making variations in excess air ratio. As result of such arrangement, the peak temperature of the first and second catalyst bodies 12 and 16 varied according to the excess air ratio λ, as shown in FIG. 14. Since the temperature of the first catalyst body 16 was increased to above 500 degrees centigrade, emissions of unburned components and CO accompanied with the excess air ratio variation were not observed, thereby making it possible to achieve clean combustion without using any-external heating means, as in EXAMPLE 4.

Figure 15:
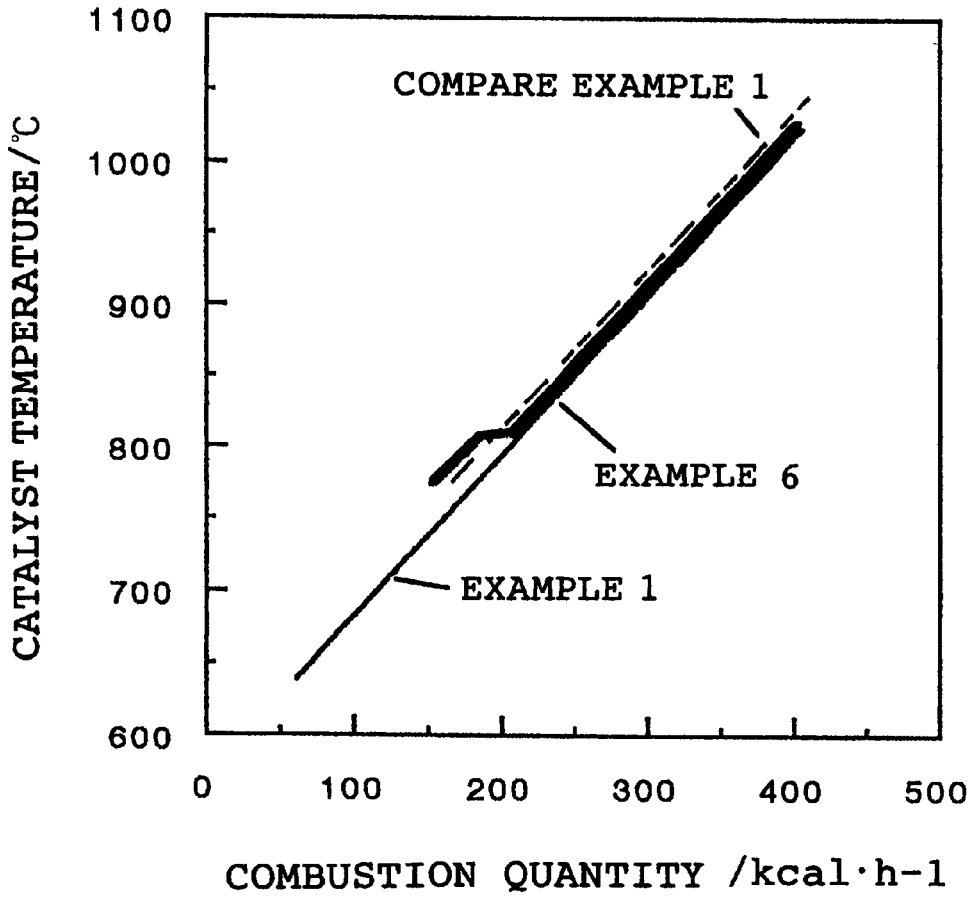
FIG. 15 graphically shows the combustion quantity dependency of peak catalyst temperatures in EXAMPLES 1 and 6 of the present invention and COMPARE EXAMPLE 1.

In EXAMPLE 6, the peak temperature of the second catalyst body 12 exhibited combustion quantity dependency shown in FIG. 15; however, no generation of unburned components and CO (accompanied with the combustion quantity dependency) was detected. In EXAMPLE 6, the excess air ratio λ of a primary premix gas was controlled so as to take a value of 1.2 at a combustion quantify of less than 180 kcal/h at which the peak temperature of the first catalyst body 12 was less than 850 degrees centigrade. As a result of such arrangement, exhaust gases were clean even when the peak temperature of the second catalyst body 16 was 500 degrees centigrade or less. The deterioration of precious metals is significantly affected by temperature. At temperatures below 850 degrees centigrade, the heat deterioration of Pt is held significantly low. For that reason, the problem of the combustion life is reduced even when the excess air ratio λ is in excess of 1. On the other hand, if the combustion quantity exceeds 180 kcal/h, this means that the peak temperature of the second catalyst body 16 exceeds 500 degrees centigrade to become capable of satisfactory purification of unburned components. Accordingly, it becomes possible to obtain clean exhaust gases without using any heating means while making utilization of the features of EXAMPLE 1 by the use of the method of EXAMPLE 6. In addition, it becomes possible to construct a catalytic combustion system capable of providing improved high-temperature resistance to catalysts. In EXAMPLE 6, the excess air ratio was varied at a border point of 180 kcal/h, which is however not considered to be restrictive. Such a border point can be set to any value according to a system structure employed as long as the same main point is achieved.

CO Emission Quantity

Figure 16:
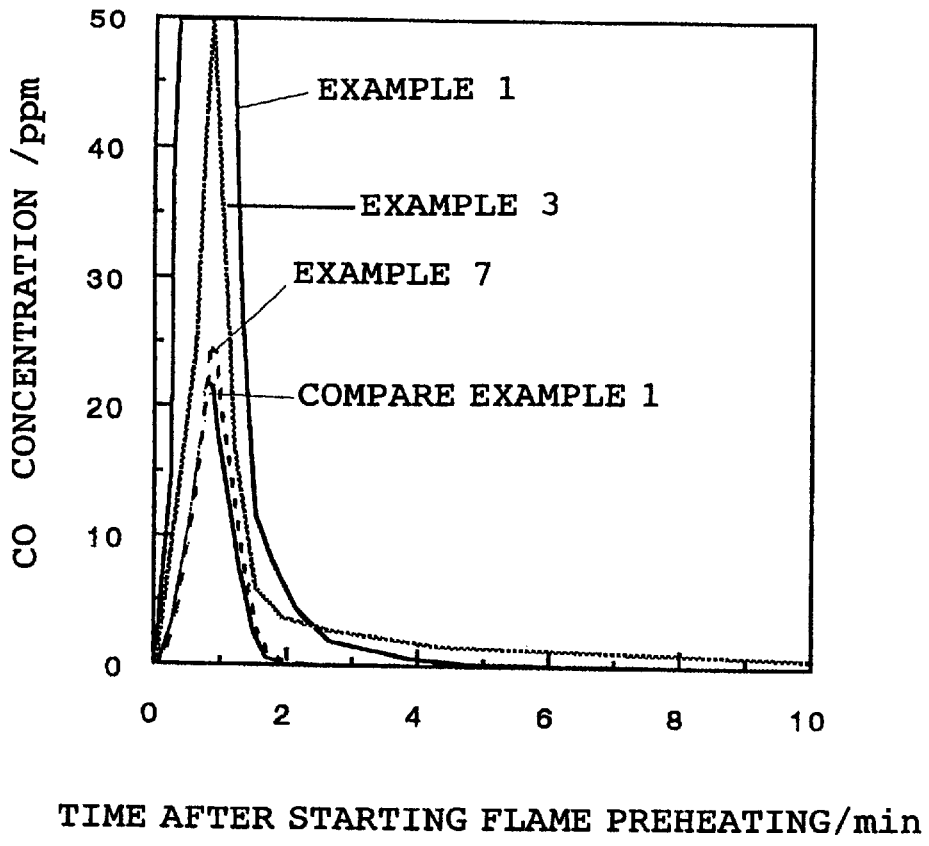
FIG. 16 graphically shows variations with time in the concentration of CO emissions after flame preheating in EXAMPLES 1, 3, and 6 of the present invention and COMPARE EXAMPLE 1.

Referring now to FIG. 16, there are shown variations in CO emission quantity from the time the first catalyst body 12 is preheated to the time post-preheat catalytic combustion starts, for EXAMPLES 1, 3, and 7 and COMPARE EXAMPLE 1. In the case of EXAMPLE 1, CO was purified if the preheat burner 5 was ignited after the second catalyst body 16 was preheated up to a temperature (i.e., about 200 degrees centigrade) capable of satisfactory oxidation of CO. If such an operation,was not added, then relatively large quantities of CO were produced. Accordingly, after all, the time for preheating the second catalyst body 16 had to be added. Although in COMPARE EXAMPLE 1, CO emissions observed were slight at the time of ignition because flame formation was carried out at an excess air ratio λ of 1.2. However, it took a time to reach a state capable of starting catalytic combustion, as in the above. In EXAMPLE 3, a flame was formed in the burner port 15 at the same time the preheat burner 5 was ignited, and what was observed was a slight increase in CO emission quantity in comparison with COMPARE EXAMPLE 1. In EXAMPLE 7, flame preheating was carried out at an excess air ratio λ of 1.2, so that the emission of CO at the start was in the same level as in normal flame combustion. The temperature sensor 17 detected the fact that the second catalyst body 16 had already reached 200 degrees centigrade at the start of catalytic combustion, and the excess air ratio was set to 0.95, thereby promptly causing catalytic combustion to start. As described above, by making use of the structure of EXAMPLE 7, it becomes possible to promptly start catalytic combustion while holding the quantity of CO emitted as low as possible. Any temperature can be set as a target of detection by the temperature sensor 17 as long as CO is oxidized at that temperature. For instance, the target temperature can be set to a high value such as about 500 degrees centigrade for carrying out oxidation of, for example, methane that slips.

CO Emission Quantity at Steady Combustion Time

TABLE 3 shows respective quantities of CO emitted at 250 kcal/h at the time of steady combustion for EXAMPLES 1–6, 8, and 9 and COMPARE EXAMPLES 1, 3, and 5.

TABLE 3

| | CO CONCENTRATION (ppm) |
|---|---|
| EXAMPLE 1 | 0.5 |
| EXAMPLE 2 | 1.0 |
| EXAMPLE 3 | 1.5 |
| EXAMPLE 4 | 1.2 |
| EXAMPLE 5 | 0.7 |
| EXAMPLE 6 | 0.5 |
| EXAMPLE 8 | 0.5 |
| EXAMPLE 9 | 0.7 |
| EXAMPLE 10 | 0.3 |
| COMPARE EXAMPLE 1 | 0.5 |
| COMPARE EXAMPLE 2 | 1.0 |
| COMPARE EXAMPLE 3 | 0.5 |
| COMPARE EXAMPLE 5 | 3.0 |

In any of these examples and compare examples, the CO emission at the steady combustion time was very small in comparison with the CO emission in normal flame combustion, proving that the second catalyst body 16 worked effectively.

As described in the third embodiment of the present invention, the provision of a mechanism capable of preheating by burned exhaust gases for secondary gaseous mixture or air makes it possible to achieve a considerable reduction in electric power required for preheating the second catalyst body 16 in cases such as EXAMPLE 1. Additionally, in the case of EXAMPLE 4, it is possible to increase the quantity of combustion in the first catalyst body 12, therefore making it possible to reduce the low temperature critical combustion quantity to a further extent.

In the examples of the present invention, catalysts supported on honeycomb structures have been described, which is however not considered to be restrictive. Any other structures in any manner will display the same effects that the honeycomb structure does.

For example, in EXAMPLE 1, the excess air ratio $\lambda$ of gaseous mixtures that are supplied to the primary combustion chamber 11 is fixed-value controlled, that is, $\lambda$=0.95. However, there is no problem of setting the excess air ratio to any value less than 1 and within a range capable of catalytic combustion. The total excess air ratio $\lambda$ of gaseous mixtures that are supplied to the secondary combustion chamber 14 was set at 1.2, which is however not considered to be restrictive. It is possible to employ any excess air condition capable of achieving the purpose of the invention, preferably $\lambda>1$. Alternatively, the total excess air ratio $\lambda$ may be equal to or less than 1 when combustible exhaust gas components are sufficiently oxidizable by diffused air or the like.

In accordance with the present structure, there is made variation in excess air ratio ($\lambda$) under a specific condition, that is, at a fixed combustion quantity, and determination of the excess air ratio $\lambda$ is made from a position at which the peak catalyst temperature reaches a maximum. In order to deal with such determination, other mechanisms capable of chemically detecting the concentration of $H_2$, CO, and hydrocarbon contained in exhaust gases of the first catalyst body can be used.

Effects of the Invention

As can obviously been seen from the foregoing description, in accordance with the present invention, the deterioration of catalysts for combustion under a combustion condition of above 800 degrees centigrade can be held low. Additionally, it becomes possible to provide catalytic combustion systems capable of expansion of the TDR (turn down ratio) and emissions of clean exhaust gases, and combustion catalysts for use therein.

What is claimed is:

1. A catalytic combustion system comprising:

(a) a gaseous mixture inlet port, located at the upstream side of said catalytic combustion system, for the entrance of a fuel-air mixture;

(b) an exhaust gas outlet port, located at the downstream side of said catalytic combustion system, for the exit of an exhaust gas;

(c) a primary constant combustion chamber in which a first catalyst body is disposed, said catalyst body having a porous base material with numerous communicating holes that supports thereon an oxidation catalyst;

(d) an ignition unit located upstream from the first catalyst body;

(e) a preheat burner located upstream from the first catalyst body;

(f) a secondary supply port, located downstream of said primary combustion chamber, for the supply of a gaseous mixture or air; and (g) a secondary combustion chamber located downstream of said secondary supply port;

wherein an excess air ratio of said primary constant combustion chamber is initially set above 1 and after the rate of combustion of said secondary combustion chamber exceeds a given level, combustion is made to take place, with the excess air ratio of said primary combustion chamber set below 1, and with the excess air ratio set below 1, combustion is not complete in the primary combustion chamber.

2. The catalytic combustion system as defined in claim 1 wherein said oxidation catalyst comprises either Pt or Rh, or comprises a material which contains therein either Pt or Rh as a major contributor to catalytic reactions.

3. The catalytic combustion system as defined in claim 1 wherein said given condition is satisfied when the rate of combustion in said secondary combustion chamber is at a given level or when the concentration of a combustible component in an exhaust gas is at a given level.

4. The catalytic combustion system as defined in claim 2 wherein said given condition is satisfied when the rate of combustion in said secondary combustion chamber is at a given level or when the concentration of a combustible component in an exhaust gas is at a given level.

5. The catalytic combustion system as defined in claim 1 wherein said secondary combustion chamber has a second catalyst body which is formed of a porous base material with numerous communicating holes that supports thereon an oxidation catalyst.

6. The catalytic combustion system as defined in claim 2 wherein said secondary combustion chamber has a second catalyst body which is formed of a porous base material with numerous communicating holes that supports thereon an oxidation catalyst.

7. The catalytic combustion system as defined in claim 1 wherein air, which is supplied to said second combustion chamber, is preheated by application of heat from exhaust gases of said secondary combustion chamber.

8. The catalytic combustion system as defined in claim 2 wherein air, which is supplied to said second combustion chamber, is preheated by application of heat from exhaust gases of said secondary combustion chamber.

9. The catalytic combustion system as defined in claim 1 wherein the excess air ratio of a gaseous mixture, which is supplied from said gaseous mixture inlet port, is reduced as the amount of a fuel component contained in said gaseous mixture decreases.

10. The catalytic combustion system as defined in claim 2 wherein the excess air ratio of a gaseous mixture, which is supplied from said gaseous mixture inlet port, is reduced as the amount of a fuel component contained in said gaseous mixture decreases.

11. The catalytic combustion system as defined in claim 1 wherein the amount of a fuel component of a gaseous mixture, which is supplied from said gaseous mixture inlet port, is held substantially constant while only the amount of air in said gaseous mixture is increased or decreased and wherein a corresponding amount of air to such an increase or decrease is supplied from said secondary supply port.

12. The catalytic combustion system as defined in claim 2 wherein the amount of a fuel component of a gaseous mixture, which is supplied from said gaseous mixture inlet port, is held substantially constant while only the amount of air in said gaseous mixture is increased or decreased and wherein a corresponding amount of air to such an increase or decrease is supplied from said secondary supply port.

13. The catalytic combustion system as defined in claim 1 wherein the excess air ratio of a gaseous mixture, which is supplied from said gaseous mixture inlet port, is set above 1 until the time the temperature of said second catalyst body increases up to a given value.

14. The catalytic combustion system as defined in claim 2 wherein the excess air ratio of a gaseous mixture, which is supplied from said gaseous mixture inlet port, is set above 1 until the time the temperature of said second catalyst body increases up to a given value.

15. The catalytic combustion system as defined in claim 1 wherein the excess air ratio of a gaseous mixture, which is supplied from said gaseous mixture inlet port, is less than 1 if the quantity of combustion in said primary combustion chamber exceeds a given value, while said gaseous mixture excess air ratio is not less than 1 if said primary combustion chamber combustion quantity is less than said given value.

16. The catalytic combustion system as defined in claim 2 wherein the excess air ratio of a gaseous mixture, which is supplied from said gaseous mixture inlet port, is less than 1 if the quantity of combustion in said primary combustion chamber exceeds a given value, while said gaseous mixture excess air ratio is not less than 1 if said primary combustion chamber combustion quantity is less than said given value.

17. The catalytic combustion system as defined in claim 1 wherein said base material of said first catalyst materials has a heat transfer rate of not less than 10W/m·° C.

18. The catalytic combustion system as defined in claim 2 wherein said base material of said first catalyst materials has a heat transfer rate of not less than 10W/m·° C.

19. The catalytic combustion system as defined in claim 2 wherein said first catalyst body, on which Pt or an oxidation catalyst containing therein Pt as a major contributor to catalytic reactions is supported, is formed by lamination of (i) a layer of Pt or an oxidation catalyst layer containing therein Pt as a major contributor to catalytic reactions and (ii) an oxidation catalyst layer containing therein Rh or Pd as a major contributor to catalytic reactions.

20. The catalytic combustion system as defined in claim 19 wherein said oxidation catalyst layer, which contains therein Rh or Pd as a major contributor to catalytic reactions and which overlies said Pt layer or said oxidation catalyst layer containing therein Pt as a major contributor to catalytic reactions, is partially formed at the downstream side.

21. The catalytic combustion system as defined in claim 2 wherein said catalyst body, on which Pt or Rh is supported, or on which an oxidation catalyst containing therein Pt or Rh as a major contributor to catalytic reactions, contains, as a major component thereof, at least $CeO_2$ or $ZrO_2$, or both.

22. The catalytic combustion system as defined in claim 1 wherein a method of causing said combustion to take place while setting the excess air ratio of said primary combustion chamber below 1 is employed which includes (i) varying the excess air ratio of said primary combustion chamber to determine, with the aid of a temperature sensor located in the vicinity of said catalyst body, an excess air ratio value at which said catalyst body reaches a temperature peak and (ii) causing combustion to take place in said primary combustion chamber within a zone having an excess air ratio lower than said determined value.

23. A combustion control method for use in a catalytic combustion system having (a) a gaseous mixture inlet port, located at the upstream side of said catalytic combustion system, for the entrance of a fuel-air mixture;

(b) an exhaust gas outlet port, located at the downstream side of said catalytic combustion system, for the exit of an exhaust gas;

(c) a primary constant combustion chamber in which a catalyst body is disposed, said catalyst body being formed of a porous base material with numerous communicating holes that supports thereon an oxidation catalyst;

(d) an ignition unit located upstream from the first catalyst body;

(e) a preheat burner located upstream from the first catalyst body;

(f) a secondary supply port, located downstream of said primary combustion chamber, for the supply of a gaseous mixture of air; and (g) a secondary combustion chamber located downstream of said secondary supply port;

comprising such process that an excess air ratio of said primary constant combustion chamber is initially set above 1 and after the rate of combustion of said secondary combustion chamber exceeds a given level, combustion is made to take place, with the excess air ratio of said primary combustion chamber set below 1, and with the excess air ratio set below 1, combustion is not complete in the primary combustion chamber.

24. A catalytic combustion system comprising:

(a) a gaseous mixture inlet port, located at the upstream side of said catalytic combustion system, for the entrance of a fuel-air mixture;

(b) an exhaust gas outlet port, located at the downstream side of said catalytic combustion system, for the exit of an exhaust gas;

(c) a primary combustion chamber in which a first catalyst body is disposed, said catalyst body having a porous base material with numerous communicating holes that supports thereon an oxidation catalyst;

(d) an ignition unit located upstream from the first catalyst body;

(e) a preheat burner located upstream from the first catalyst body;

(f) a glass located upstream of the first catalyst body and in a face to face arrangement therewith;

(g) a secondary supply port, located downstream of said primary combustion chamber, for the supply of a gaseous mixture or air; and (h) a secondary combustion chamber located downstream of said secondary supply port;

wherein an excess air ratio of said primary constant combustion chamber is initially set above 1 and after the rate of combustion of said secondary combustion chamber exceeds a given level, combustion is made to take place, with the excess air ratio of said primary combustion chamber set below 1, and with the excess air ratio set below 1, combustion is not complete in the primary combustion chamber.

25. A catalytic combustion system comprising:

(a) a gaseous mixture inlet port, located at the upstream side of said catalytic combustion system, for the entrance of a fuel-air mixture;

(b) an exhaust gas outlet port, located at the downstream side of said catalytic combustion system, for the exit of an exhaust gas;

(c) a primary combustion chamber in which a first catalyst body is disposed, said catalyst body having a porous base material with numerous communicating holes that supports thereon an oxidation catalyst;

(d) an ignition unit located upstream from the first catalyst body;

(e) a preheat burner located upstream from the first catalyst body;

(f) a glass located upstream of the first catalyst body and in a face to face arrangement therewith;

(g) a secondary supply port, located downstream of said primary combustion chamber, for the supply of a gaseous mixture or air; and (h) a secondary combustion chamber located downstream of said secondary supply port;

wherein an excess air ratio of said primary constant combustion chamber is initially set above 1 and after the rate of combustion of said secondary combustion chamber exceeds a given level, combustion is made to take place, with the excess air ratio of said primary combustion chamber set below 1;

with the excess air ratio set below 1, combustion is not complete in the primary combustion chamber; and said oxidation catalyst comprises a platinum group metal.

* * * * *